US009084298B2

(12) United States Patent
Hirochi et al.

(10) Patent No.: US 9,084,298 B2
(45) Date of Patent: Jul. 14, 2015

(54) SUBSTRATE PROCESSING APPARATUS INCLUDING SHIELDING UNIT FOR SUPPRESSING LEAKAGE OF MAGNETIC FIELD

(75) Inventors: Yukitomo Hirochi, Toyama (JP); Akinori Tanaka, Toyama (JP); Akihiro Sato, Toyama (JP); Takeshi Itoh, Toyama (JP); Daisuke Hara, Toyama (JP); Kenji Shirako, Toyama (JP); Kazuhiro Morimitsu, Toyama (JP); Masanao Fukuda, Toyama (JP)

(73) Assignee: Hitachi Kokusai Electric Inc., Tokyo (JP)

( * ) Notice: Subject to any disclaimer, the term of this patent is extended or adjusted under 35 U.S.C. 154(b) by 232 days.

(21) Appl. No.: 13/034,035

(22) Filed: Feb. 24, 2011

(65) Prior Publication Data

US 2011/0210118 A1 Sep. 1, 2011

(30) Foreign Application Priority Data

Feb. 26, 2010 (JP) ..... 2010-042818
Mar. 24, 2010 (JP) ..... 2010-067196

(51) Int. Cl.
*H05B 6/10* (2006.01)
*H05B 6/02* (2006.01)

(52) U.S. Cl.
CPC ..... *H05B 6/108* (2013.01)

(58) Field of Classification Search
CPC ..... H05B 6/00; H05B 6/02; H05B 6/10
USPC ..... 219/647, 446.1, 390, 405–416, 651; 118/724, 725; 392/416
See application file for complete search history.

(56) References Cited

U.S. PATENT DOCUMENTS 4,943,235 A 7/1990 Nakao et al.
5,632,820 A 5/1997 Taniyama et al.
5,990,453 A * 11/1999 Das et al. ..... 219/405

(Continued)

FOREIGN PATENT DOCUMENTS

JP 01-251610 A 10/1989
JP 08-195354 A 7/1996

(Continued)

*Primary Examiner* — Dana Ross
*Assistant Examiner* — Michael Laflame, Jr.
(74) *Attorney, Agent, or Firm* — Volpe and Koenig, P.C.

(57) ABSTRACT

There are provided a substrate processing apparatus capable of suppressing leakage of magnetic field during processing of a substrate. The substrate processing apparatus of the present invention includes: a reaction tube having a processing chamber provided therein to process a substrate; an induction heating unit installed outside of the reaction tube to accommodate the reaction tube, wherein the induction heating unit is configured to electromagnetically induction-heat the processing chamber by generating a magnetic field; an accommodation tube installed outside of the induction heating unit to accommodate the induction heating unit, wherein the accommodation tube accommodates the reaction tube and the induction heating unit in an air-tight manner; a shielding unit made of a conductive material installed to surround an outside of the accommodation tube; and an inert gas supply unit installed in a gap between the reaction tube and the accommodation tube where the induction heating unit is installed, wherein the inert gas supply unit is configured to supply an inert gas into the gap.

7 Claims, 13 Drawing Sheets

(56) References Cited

U.S. PATENT DOCUMENTS

| | | | | |
|---|---|---|---|---|
| 6,331,212 | B1 * | 12/2001 | Mezey, Sr. | 118/725 |
| 2002/0063119 | A1 * | 5/2002 | Tanaka et al. | 219/390 |
| 2002/0125223 | A1 * | 9/2002 | Johnson et al. | 219/121.43 |
| 2003/0071035 | A1 * | 4/2003 | Brailove | 219/672 |
| 2009/0065486 | A1 * | 3/2009 | Yamashita | 219/121.58 |
| 2009/0325116 | A1 * | 12/2009 | Matsuura et al. | 432/198 |

FOREIGN PATENT DOCUMENTS

| | | |
|---|---|---|
| JP | 11-236675 | 8/1999 |
| JP | 2002-526915 | 8/2002 |
| JP | 2006-261363 | 9/2006 |
| JP | 2007-180132 | 7/2007 |
| JP | 2008-251995 | 10/2008 |

* cited by examiner

SUBSTRATE PROCESSING APPARATUS INCLUDING SHIELDING UNIT FOR SUPPRESSING LEAKAGE OF MAGNETIC FIELD

This application claims priority to and the benefit of Japanese Patent Application No. 2010-042818 filed on Feb. 26, 2010 and No. 2010-067196 filed on Mar. 24, 2010, the disclosure of which is incorporated herein by reference.

FIELD OF THE INVENTION

The present invention relates to a substrate processing apparatus for processing a substrate, and more particularly, to a substrate processing apparatus for forming a silicon carbide (hereinafter, referred to as "SiC") epitaxial film on a substrate.

DESCRIPTION OF THE RELATED ART

A silicon (Si) substrate having a SiC epitaxial film grown on a surface thereof has come into the spotlight as a material for power devices. The SiC epitaxial film may be formed by supplying a source gas containing a Si element and a source gas containing a carbon element into a reaction tube while heating a substrate loaded in the reaction tube at 1500 to 1800° C.

A vertical film-forming apparatus used for a Si film-forming apparatus processes a plurality of (25 to 100) wafers at once by stacking the wafers in a longitudinal direction such that the wafers have a footprint (occupied area) of single wafer. Therefore, the vertical film-forming apparatus can be applied to a SiC epitaxial film formation as disclosed in Patent Documents 1 and 2 because the vertical film-forming apparatus is advantageous for mass-production.

Patent Document 1 discloses a heat processing furnace of the vertical semiconductor manufacturing apparatus wherein the heat processing furnace is configured to air-tightly surround a lower end of a reaction tube by a scavenger, supply an inert gas from an predetermined position of the scavenger, and exhaust the inert gas from the other position.

Patent Document 2 discloses a thermal processing apparatus including a case installed below a base plate installed at a lower portion of a vertical heat processing furnace, and a scavenger installed to surround the outside of the case.

PRIOR-ART DOCUMENTS

Patent Documents

[Patent Document 1] Japanese Patent Laid-Open Publication No. H08-195354

[Patent Document 2] Japanese Patent Laid-Open Publication No. H01-251610

A first disadvantage of related art is as follows.

In order to achieve the above-described temperature range, an induction heating technique is used for example. More particularly, an induction coil is installed to surround a reaction tube, and an object to be heated made of carbon is installed to surround a substrate in the reaction tube. The object to be heated is induction-heated by allowing an alternating current to flow through the induction coil, and the substrate is heated by a heat radiated from the object to be heated. However, in the above-described method, metal members installed outside the induction coil is also heated to a high temperature due to an induction current flowing through the metal members, resulting in an increased risk Therefore, it is a first object of the present invention to provide a substrate processing apparatus and a method of manufacturing a semiconductor device capable of suppressing induction-heating of the metal members installed outside the induction coil, and improving safety during processing of the substrate.

Moreover, a second disadvantage is as follows.

The vertical semiconductor manufacturing apparatuses disclosed in Patent Documents 1 and 2 employ resistance heating-type heaters. Therefore, when a hydrogen ($H_2$) gas is used as a carrier gas, the hydrogen gas in the reaction chamber may be leaked, and an explosion may occur due to a friction between a resistance heating body and the gas or a static electricity.

Therefore, it is a second object of the present invention to provide a thermal processing apparatus, a method of manufacturing a semiconductor device, and a method of manufacturing a substrate capable of preventing leakage of a gas from a processing chamber.

SUMMARY OF THE INVENTION

According to one embodiment of the present invention, there is provided a substrate processing apparatus comprising: a reaction tube for accommodating a substrate; an induction heating unit installed to surround an outer circumference of the reaction tube, the induction heating unit being configured to generate a magnetic field; a shielding unit made of a conductive material installed to surround an outside of the induction heating unit; a gas supply unit configured to supply at least a source gas into the reaction tube; and a controller configured to control the induction heating unit to heat an inside of the reaction tube and the gas supply unit to supply at least the source gas into the reaction tube to process the substrate.

According to another embodiment of the present invention, there is provided a method of manufacturing a semiconductor device comprising steps of: loading a substrate into a reaction tube; heating an inside of the reaction tube using an induction heating unit surrounding the reaction tube, wherein the induction heating unit surrounded by a shielding unit made of a conductive material is configured to generate magnetic field; supplying at least a source gas from a gas supply unit into the reaction tube to process the substrate; and unloading the substrate from the reaction tube.

According to still another embodiment of the present invention, there is provided a method of manufacturing a substrate comprising steps of: loading a substrate into a reaction tube; heating an inside of the reaction tube using an induction heating unit surrounded by a shielding unit and installed to surround an outside of the reaction tube; processing the substrate by supplying at least a source gas from a gas supply unit into the reaction tube; and unloading the substrate from the reaction tube.

According to yet another embodiment of the present invention, there is provided a substrate processing apparatus including: a reaction tube having a processing chamber provided therein to process a substrate; an induction heating unit installed outside of the reaction tube configured to accommodate the reaction tube, wherein the induction heating unit is configured to electromagnetically induction-heat the processing chamber by generating a magnetic field; an accommodation tube installed outside of the induction heating unit to accommodate the induction heating unit, wherein the accommodation tube accommodates the reaction tube and the induction heating unit in an air-tight manner; a shielding unit made of a conductive material installed to surround an outside of the accommodation tube; and an inert gas supply unit installed in a gap between the reaction tube and the accommodation tube where the induction heating unit is installed, wherein the inert gas supply unit is configured to supply an inert gas into the gap.

DETAILED DESCRIPTION OF THE PREFERRED EMBODIMENTS

Hereinafter, an embodiment of the present invention used to solve the first disadvantage will be described with reference to the accompanying drawings.

First Embodiment

(1) Configuration of Substrate Processing Apparatus

Figure 1:
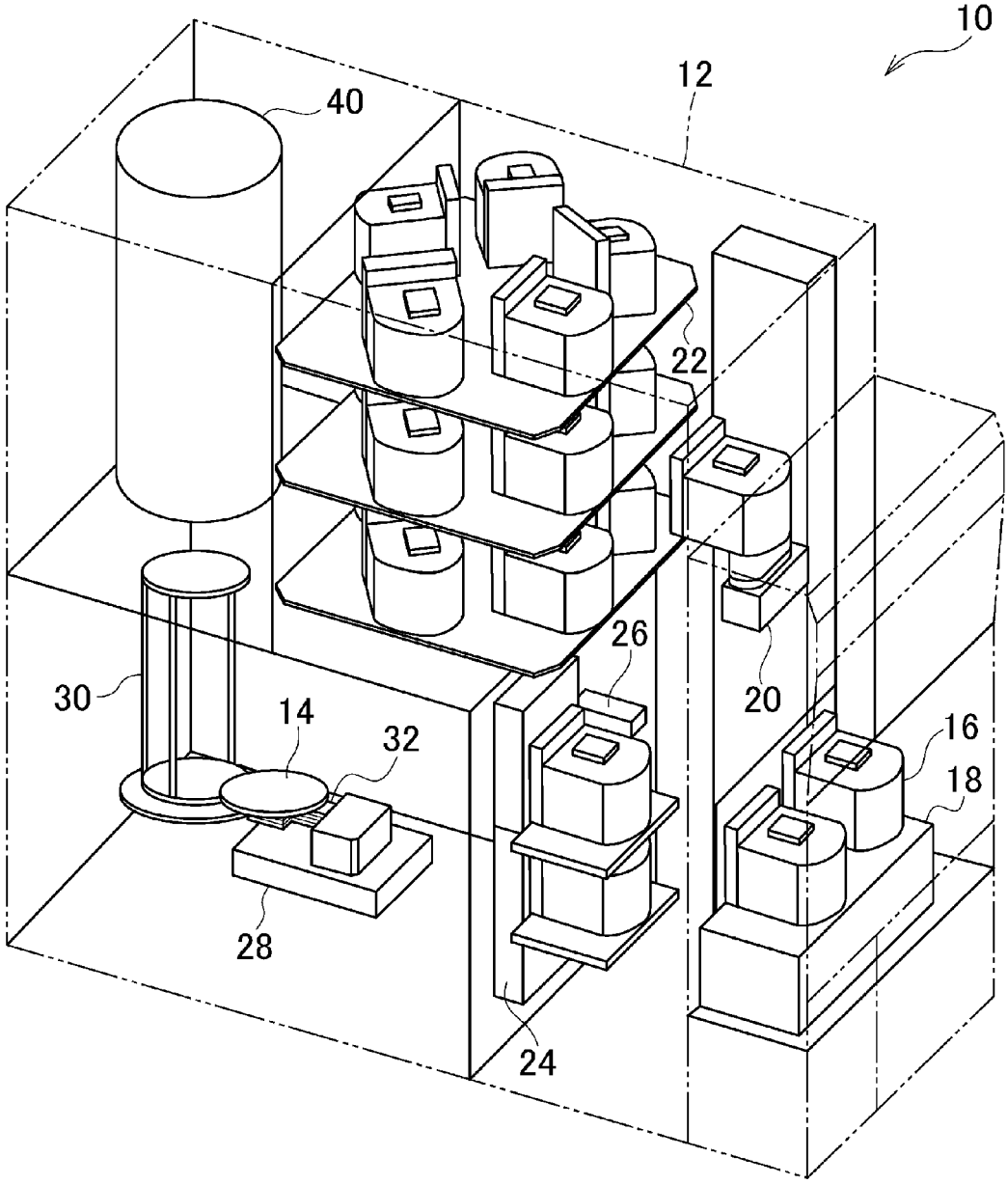
FIG. 1 is a perspective view of a substrate processing apparatus 10 according to a first embodiment of the present invention.
Figure 2:
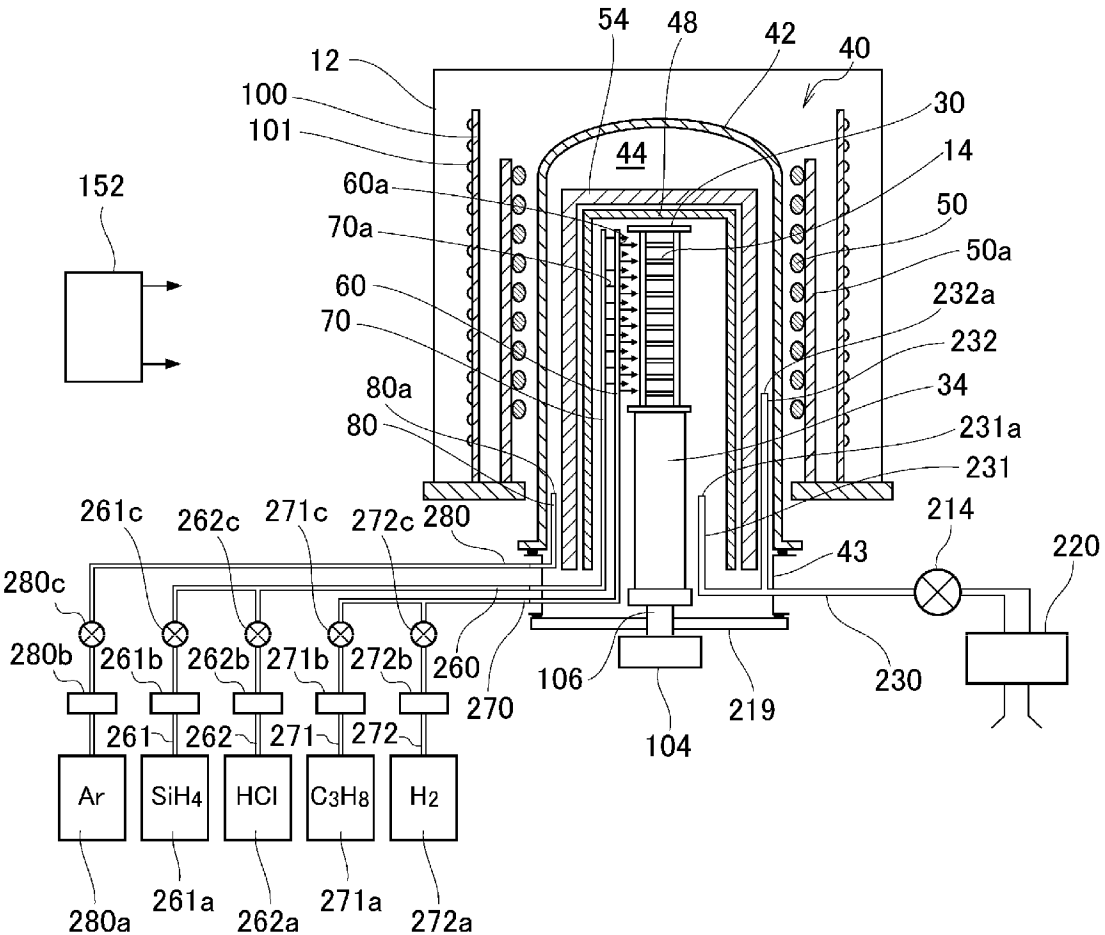
FIG. 2 is a lateral cross-sectional view of a processing furnace 40 according to the first embodiment of the present invention.
Figure 3:
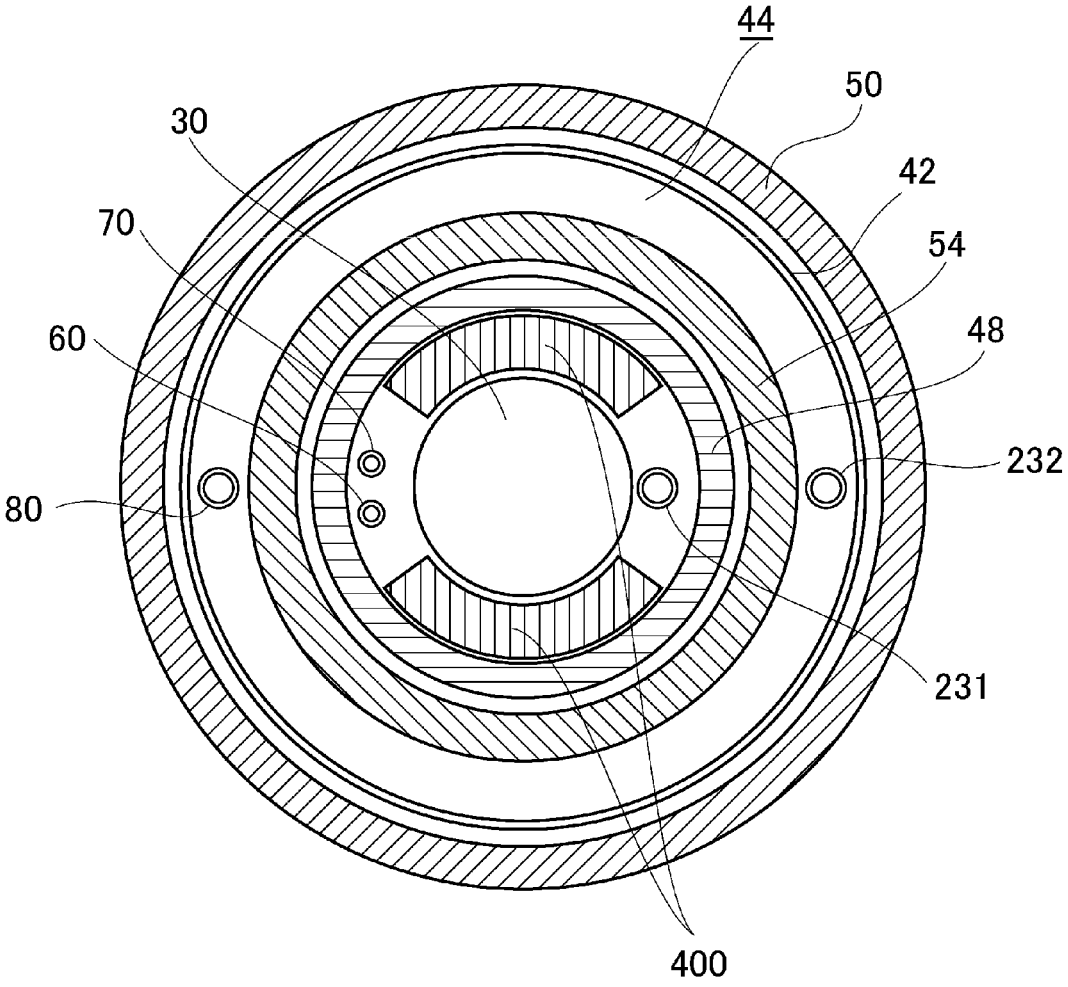
FIG. 3 is a top cross-sectional view of the processing furnace 40 according to the first embodiment of the present invention.
Figure 4:
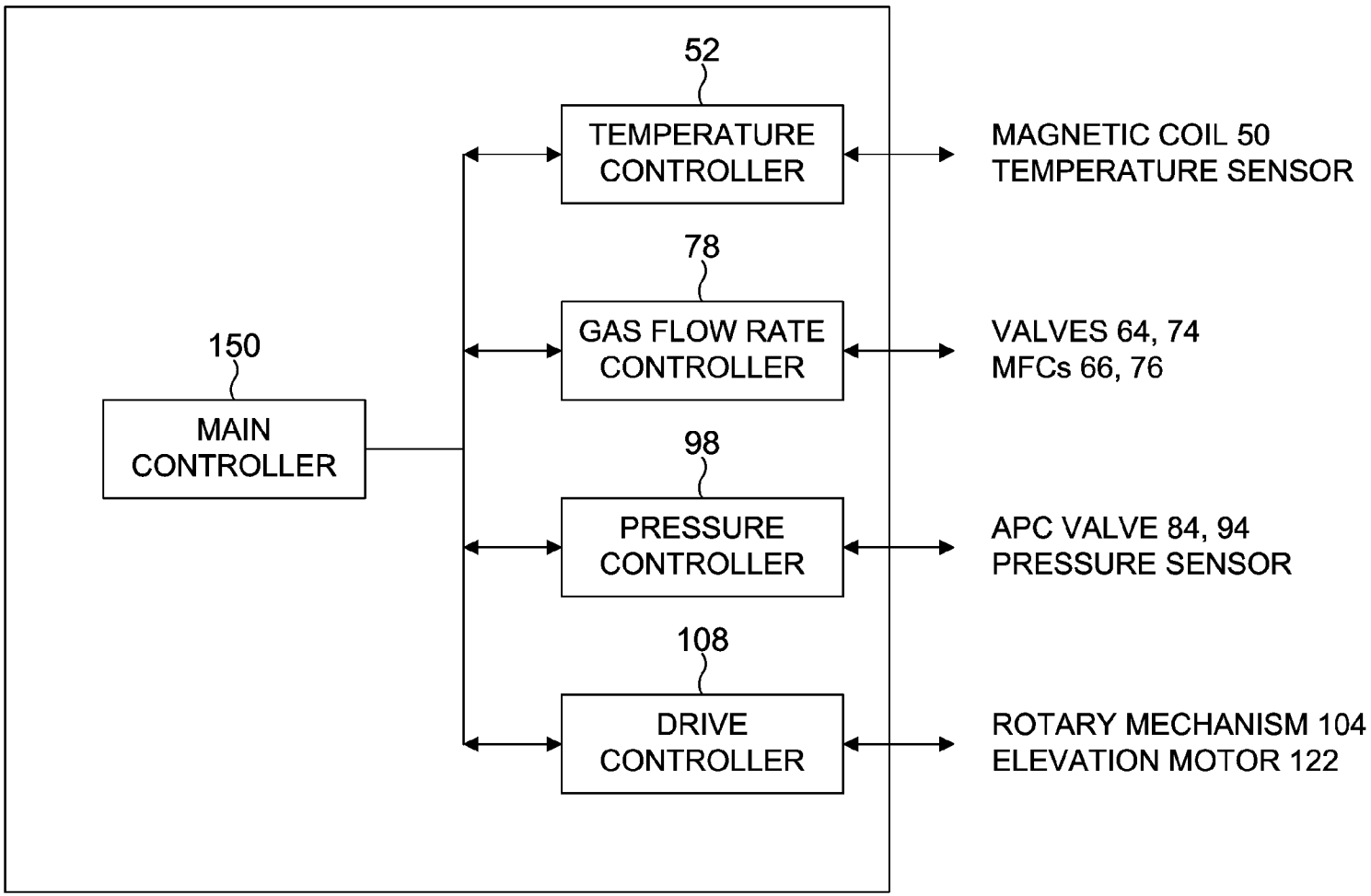
FIG. 4 is a block configuration diagram of a controller 152 according to the first embodiment of the present invention.
Figure 5:
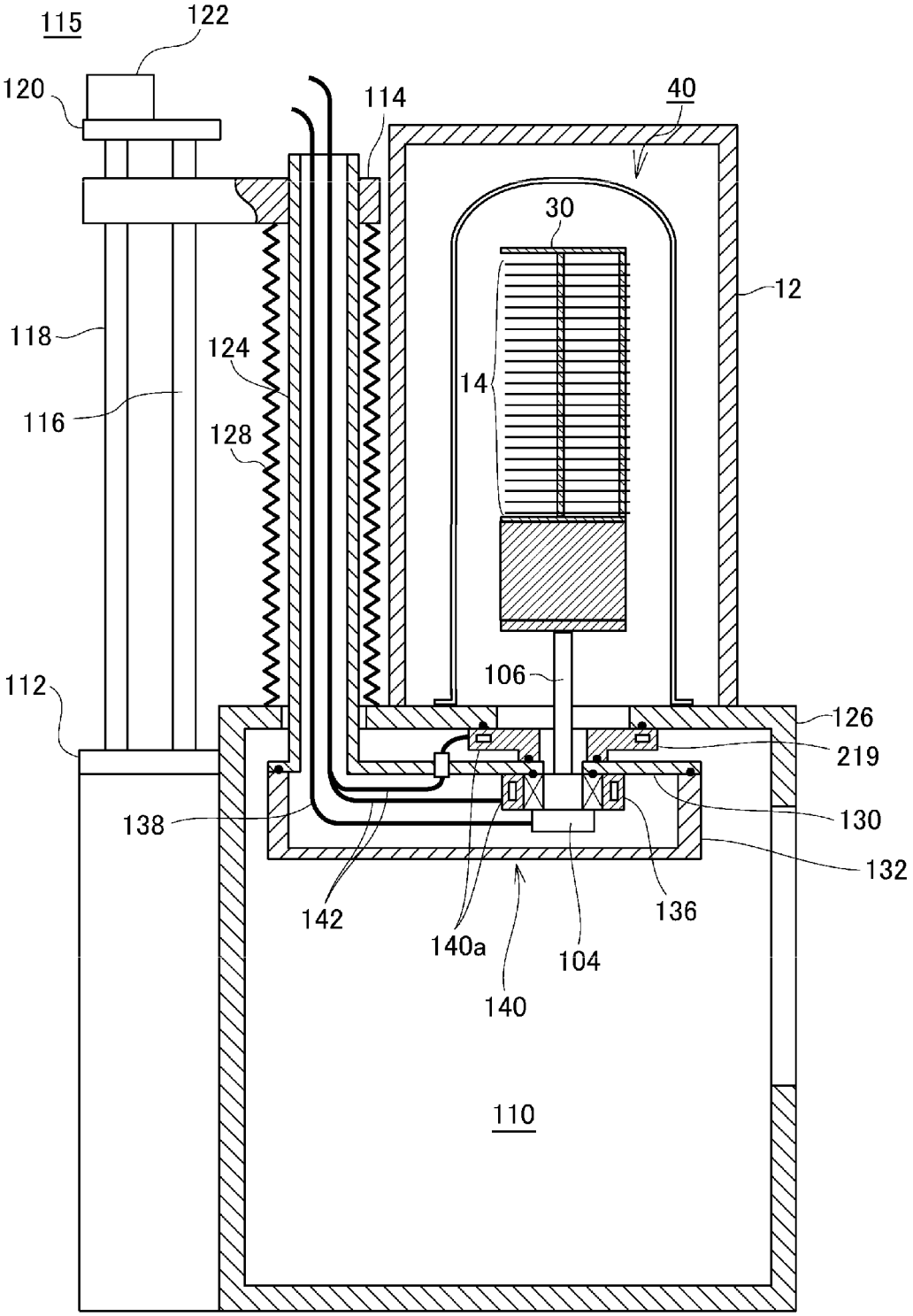
FIG. 5 is a diagram schematically illustrating the processing furnace 40 and a surrounding structure thereof according to the first embodiment of the present invention.

First, a configuration of a substrate processing apparatus 10 according to the first embodiment will be described with reference to FIGS. 1 through 5 and 7. FIG. 1 is a perspective view of the substrate processing apparatus 10 according to the first embodiment. FIG. 2 is a lateral cross-sectional view of a processing furnace 40 according to the first embodiment. FIG. 3 is a top cross-sectional view of the processing furnace 40 according to the first embodiment. FIG. 4 is a block configuration diagram of a controller 152 according to the first embodiment. FIG. 5 is a diagram schematically illustrating the processing furnace 40 and a surrounding structure thereof according to the first embodiment.

<Overall Configuration>

The substrate processing apparatus 10 is a batch-type vertical thermal processing apparatus. The substrate processing apparatus 10 has a housing 12 provided therein. Main parts such as a processing furnace 40 are installed in the housing 12. A pod 16 is used as a substrate transfer vessel (a wafer carrier) for transferring a substrate into the housing 12. An inner part of the pod 16 accommodates, for example, twenty-five wafers 14 as the substrate made of Si or SiC. A pod stage 18 is disposed at a front side of the housing 12. The pod 16 is placed on the pod stage 18 with a lid thereof closed.

A pod transfer device 20 is installed at a front side (shown on the right side of FIG. 1) in the housing 12, which is opposite to the pod stage 18. A pod placement shelf 22, a pod opener 24, and a wafer count detector 26 are installed in the vicinity of the pod transfer device 20. The pod placement shelf 22 is disposed above the pod opener 24, and is configured to hold a plurality of the pods 16 thereon. The wafer count detector 26 is installed adjacent to the pod opener 24. The pod transfer device 20 transfers the pod 16 among the pod stage 18, the pod placement shelf 22, and the pod opener 24. The pod opener 24 is configured to open the lid of the pod 16. The wafer count detector 26 detects the number of the wafers 14 in the pod 16 with the lid thereof open.

A wafer transfer machine 28 and a boat 30 serving as a substrate holding mechanism are installed inside the housing 12. The wafer transfer machine 28 includes an arm (tweezers) 32, and is configured to be vertically rotated by means of a driving means (not shown). The arm 32 extracts, for example, five wafers at once. By moving the arm 32, the wafer 14 may be transferred between the pod 16 and the boat 30 which are disposed at a position of the pod opener 24.

The boat 30 is, for example, made of a heat-resistant material such as carbon graphite and SiC. The boat 30 is configured in a manner that the plurality of wafers in a horizontal posture 14 are concentrically stacked and held in a longitudinal direction by the boat 30. A boat insulation unit 34 of a disc-type heat insulating member made of a heat-resistant material such as quartz and SiC is disposed under the boat 30 (see FIG. 2). The boat insulation unit 34 prevents a heat from being easily transferred from an object 48 to be heated, which will be described later, to a lower side of a processing furnace 40, which will also be described later.

The processing furnace 40 is installed at a rear upper portion in the housing 12. The boat 30 having the plurality of wafers 14 charged therein is loaded into the processing furnace 40 through a lower portion of the processing furnace 40.

<Configuration of Processing Furnace>

FIGS. 2 and 3 are lateral and top cross-sectional views of the processing furnace 40 for forming a SiC epitaxial film on the wafer 14, respectively.

(Reaction Container)

The processing furnace 40 includes a reaction tube 42. The reaction tube 42 is made of the heat-resistant material such as quartz ($SiO_2$) and SiC, and has a cylindrical shape with an upper end thereof closed and a lower end thereof open. A reaction chamber 44 is formed in a cylindrical hollow portion in the reaction tube 42. The reaction chamber 44 accommodates and supports the wafers 14 as a substrate made of Si or SiC. The reaction chamber 44 is configured in a manner that the wafers 14 in a horizontal posture 14 are concentrically stacked and held in the longitudinal direction by the boat 30.

A manifold 43 is installed concentrically with the reaction tube 42 at a lower portion of the reaction tube 42. The manifold 43 is, for example, made of stainless steel, etc., and has a cylindrical shape with both an upper end and a lower end thereof open. The manifold 43 is installed to support the reaction tube 42 from the lower portion of the reaction tube 42. As a seal member, an O-ring is installed between the manifold 43 and the reaction tube 42. The reaction tube 42 is installed in a vertical direction with the manifold 43 being supported by a holding body (not shown). The reaction tube 42 and the manifold 43 constitute a reaction container.

(Heating Unit)

The processing furnace 40 includes an object 48 to be heated which is heated by induction heating and an induction coil 50 serving as an induction heating unit (a magnetic field generation unit). The object 48 to be heated is made of, for example, carbon, etc., and is installed to surround the boat 30 accommodated in the reaction chamber 44. The induction coil 50 is made of a heat-resistant insulating material, supported by a coil support 50*a*, and installed to surround an outer circumference of the reaction tube 42. An alternating electric power of 10 to 100 kHz and 10 to 200 kW, for example, is supplied from an alternating power source (not shown) to the induction coil 50. As an alternating current flows through the induction coil 50, an alternating magnetic field is applied to the object 48 to be heated, resulting in an induction current flowing through the object 48 to be heated. The object 48 to be heated then radiates a heat. The radiant heat from the object 48 to be heated heats the wafer 14 held by the boat 30 and the inside of the reaction chamber 44 to a temperature of 1500° C. to 1800° C., for example.

As a temperature detector for detecting an inner temperature of the reaction chamber 44, a temperature sensor (not shown) is installed in the vicinity of the object 48 to be heated. A temperature controller 52 is electrically connected to the induction coil 50 and the temperature sensor (see FIG. 4). The temperature controller 52 is configured to control the inner temperature of the reaction chamber 44 to have a predetermined temperature distribution at a predetermined time point by adjusting a power supplied to the induction coil 50 based on information on the temperature detected by the temperature sensor.

For example, an insulation material 54 made of a material such as carbon felt, which is hardly induction-heated, is installed between the object 48 to be heated and the reaction tube 42. The heat from the object 48 to be heated may be prevented from being transferred to the reaction tube 42 or to the outside of the reaction tube 42 by installing the insulation material 54.

In general, the object 48 to be heated, the induction coil 50, the coil support 50*a*, the alternating power source (not shown), the temperature detector (not shown), and the insulation material 54 constitute the heating unit according to the embodiment.

(Gas Supply System)

A first gas supply nozzle 60 through which a Si-containing gas and a chlorine-containing gas are supplied as source gases, a second gas supply nozzle 70 through which a carbon-containing gas and a hydrogen-containing gas are supplied as a source gas and a reduction gas, respectively, and a third gas supply nozzle 80 through which argon (Ar) gas is supplied as an inert gas are installed on a sidewall of the manifold 43. For example, a silane ($SiH_4$) gas, a hydrogen chloride (HCl) gas, a propane ($C_3H_8$) gas, and a hydrogen ($H_2$) gas may be used as the Si-containing gas, the chlorine-containing gas, the carbon-containing gas, and the hydrogen-containing gas, respectively.

All of the first gas supply nozzle 60, the second gas supply nozzle 70 and the third gas supply nozzle 80 are made of, for example, carbon graphite. Downstream sides of the first gas supply nozzle 60 and the second gas supply nozzle 70 are disposed between the object 48 to be heated and a loading region predetermined for the boat 30. A downstream side of the third gas supply nozzle 80 is disposed between the reaction tube 42 and the insulation material 54. A plurality of first gas supply holes 60*a* and a plurality of second gas supply holes 70*a* for supplying a gas to a space between the stacked wafers 14 are provided at side portions of the first gas supply nozzle 60 and the second gas supply nozzle 70. A third gas supply hole 80*a* is provided at a downstream end of the third gas supply nozzle 80.

A downstream end of a first gas supply tube 260 is connected to an upstream end of the first gas supply nozzle 60. Downstream ends of a Si-containing gas supply tube 261 and a chlorine-containing gas supply tube 262 are connected to an upstream side of the first gas supply tube 260. A $SiH_4$ gas supply source 261*a*, a mass flow controller (MFC) 261*b* serving as a mass flow control device (a mass flow control means), and a valve 261*c* are installed at the Si-containing gas supply tube 261 in sequence from an upstream side thereof. An HCl gas supply source 262*a*, an MFC 262*b* serving as a mass flow control device (a mass flow control means), and a valve 262*c* are installed at the chlorine-containing gas supply tube 262 in sequence from an upstream side thereof.

A downstream end of a second gas supply tube 270 is connected to an upstream end of the second gas supply nozzle 70. Downstream ends of a carbon-containing gas supply tube 271 and a hydrogen-containing gas supply tube 272 are connected to an upstream side of the second gas supply tube 270. A $C_3H_8$ gas supply source 271*a*, an MFC 271*b* serving as a mass flow control device (a mass flow control means), and a valve 271*c* are installed at the carbon-containing gas supply tube 271 in sequence from an upstream side thereof. An $H_2$ gas supply source 272*a*, an MFC 272*b* serving as a mass flow control device (a mass flow control means), and a valve 272*c* are installed at the hydrogen-containing gas supply tube 272 in sequence from an upstream side thereof.

A downstream end of a third gas supply tube 280 is connected to an upstream end of the third gas supply nozzle 80. An Ar gas supply source 280*a*, an MFC 280*b* serving as a mass flow control device (a mass flow control means), and a valve 280*c* are installed at the third gas supply tube 280 in sequence from an upstream side thereof.

The valves 261*c*, 262*c*, 271*c*, 272*c* and 280*c*, and the MFCs 261*b*, 262*b*, 271*b*, 272*b* and 280*b* are electrically connected to a gas flow rate controller 78 (see FIG. 4). The gas flow rate controller 78 is configured to control the valves 261*c*, 262*c*, 271*c*, 272*c* and 280*c* and the MFCs 261*b*, 262*b*, 271*b*, 272*b* and 280*b* such that flow rates of $SiH_4$ gas, HCl gas, $C_3H_8$ gas, $H_2$ gas and Ar gas supplied into the reaction chamber 44 can reach predetermined flow rates at a predetermined time point.

In general, the first gas supply nozzle 60, the first gas supply holes 60*a*, the first gas supply tube 260, the Si-containing gas supply tube 261, the chlorine-containing gas supply tube 262, the valves 261*c* and 262*c*, the MFCs 261*b* and 262*b*, the $SiH_4$ gas supply source 261*a*, and the HCl gas supply source 262*a* constitute a first gas supply system according to the embodiment. In addition, the second gas supply nozzle 70, the second gas supply holes 70*a*, the second gas supply tube 270, the carbon-containing gas supply tube 271, the hydrogen-containing gas supply tube 272, the valves 271*c* and 272*c*, the MFCs 271*b* and 272*b*, the $C_3H_8$ gas supply source 271*a*, and the $H_2$ gas supply source 272*a* constitute a second gas supply system according to the embodiment. Moreover, the third gas supply nozzle 80, the third gas supply hole 80*a*, the third gas supply tube 280, the valve 280*c*, the MFC 280*b*, and the argon gas supply source 280*a* constitute a third gas supply system according to the embodiment. Furthermore, the first gas supply system, the second gas supply system and the third gas supply system constitute the gas supply system according to the embodiment.

Preferably, in the reaction chamber 44, a structure 400 may be installed between the first and second gas supply nozzles 60 and 70 and a first gas exhaust port 231*a*, and between the object 48 to be heated and the wafer 14. For example, the structure 400 is installed in opposite positions, as shown in FIG. 3. Preferably, the structure 400 may be made of an insulation material or carbon felt in order to be heat resistant and to prevent formation of particles.

(Exhaust System)

An exhaust tube 230 for exhausting an inner atmosphere of the reaction chamber 44 is connected to the sidewall of the manifold 43. In the reaction chamber 44, an upstream side of the exhaust tube 230 is divided into two tubes: a first exhaust tube 231 and a second exhaust tube 232. The first exhaust tube 231 is arranged between the object 48 to be heated and the loading region predetermined for the boat 30, and the second exhaust tube 232 is arranged between the reaction tube 42 and the insulation material 54. A first gas exhaust port 231*a* is provided in an upstream end of the first exhaust tube 231, and a second gas exhaust port 232*a* is provided in an upstream end of the second exhaust tube 232.

A pressure sensor (not shown), an auto pressure controller (APC) valve 214 serving as a pressure regulator, and a vacuum pump 220 are installed at the exhaust tube 230 in sequence from an upstream side thereof. The pressure sensor (not shown), the APC valve 214, and the vacuum pump 220 are electrically connected to a pressure controller 98 (see FIG. 4). The pressure controller 98 is configured to control an opening level of the APC valve 214 so that an inner pressure of the reaction chamber 44 can reach a predetermined pressure at a predetermined time point. Generally, the exhaust tube 230, the first exhaust tube 231, the second exhaust tube 232, the first gas exhaust port 231*a*, the second gas exhaust port 232*a*, the pressure sensor (not shown), the APC valve 214, and the vacuum pump 220 constitute the exhaust system according to the embodiment.

The first gas exhaust port 231*a* is disposed to face the first gas supply holes 60*a* and the second gas supply holes 70*a* via the wafers 14. The gases supplied from the first gas supply holes 60*a* and second gas supply holes 70*a* pass through the object 48 to be heated in the reaction chamber 44, flow parallel to the wafers 14, and are exhausted through the first gas exhaust port 231*a*. Therefore, all of the wafers 14 are effectively and uniformly exposed to the gas.

The second gas exhaust port 232*a* is disposed to face the third gas supply hole 80*a* via the insulation material 54. The gas supplied from the third gas supply hole 80*a* flows between the reaction tube 42 and the insulation material 54, and is exhausted through the second gas exhaust port 232*a*. Therefore, the Si-containing gas, the carbon-containing gas, the chlorine-containing gas and a mixture gas thereof are prevented from penetrating a space between the reaction tube 42 and the insulation material 54, and attachment of unnecessary products to an inner wall of the reaction tube 42 and an outer wall of the insulation material 54 may be prevented.

(Shielding Unit)

Figure 7:
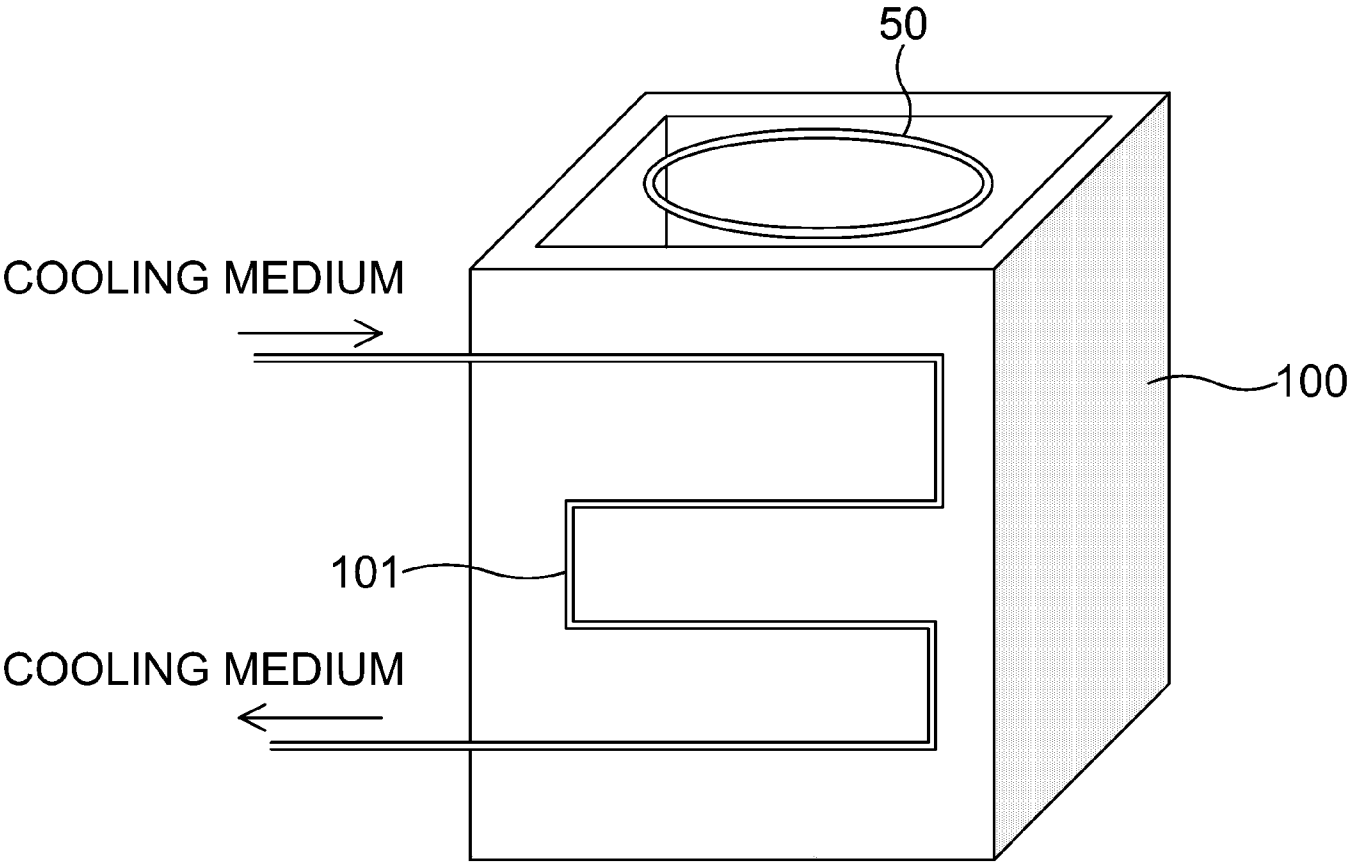
FIG. 7 is a diagram schematically illustrating the shielding plate 100 according to the first embodiment of the present invention.
Figure 8:
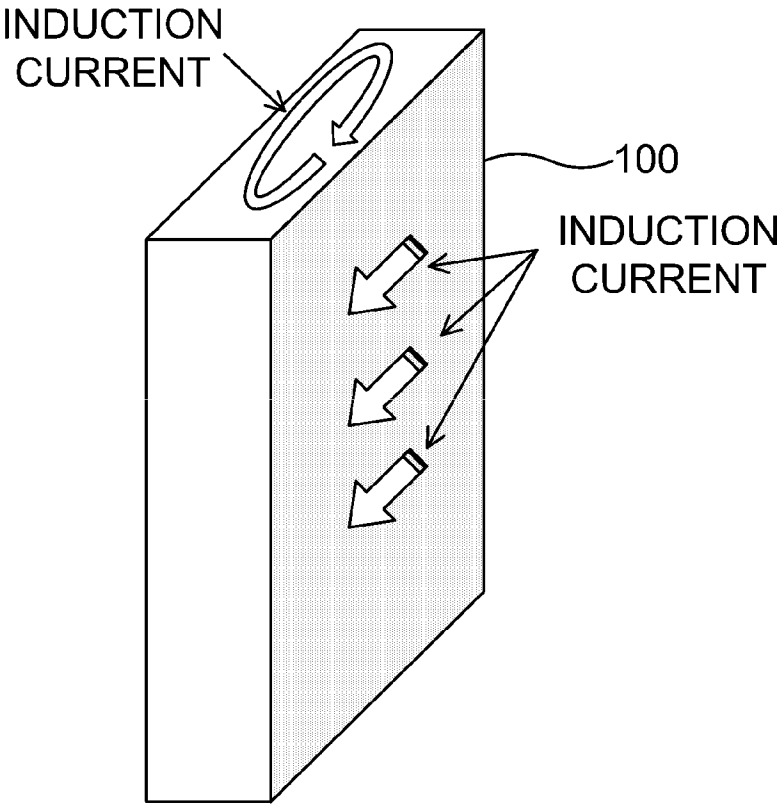
FIG. 8 is a partial enlarged view of the shielding plate 100 according to the first embodiment of the present invention.

As a shielding unit having a column or a prism shape for surrounding the outside of the induction coil 50, a shielding plate 100, for example, is installed outside the induction coil 50 serving as the induction heating unit. FIG. 7 is a diagram schematically illustrating the shielding plate 100 according to the first embodiment of the present invention. The shielding plate 100 is made of a conductive material such as copper (Cu). The shielding plate 100 suppresses the flow of the induction current through a conductive member such as a screw and a nut provided in the housing 12 installed outside the shielding plate 100 when an alternating current flows through the induction coil 50. That is, by enabling the induction current to strongly flow through a surface of the shielding plate 100 installed outside the induction coil 50 when an alternating current flows through the induction coil 50, an electromagnetic induction at the outside of the shielding plate 100 may be shielded. FIG. 8 is a diagram schematically illustrating the induction current flowing through the shielding plate 100.

Preferably, as an example of the shielding unit according to the embodiment, the shielding plate 100 may be integrally installed to surround the outside of the induction coil 50 without a gap. Therefore, when the alternating current flows through the induction coil 50, it can be ensured that the induction current flows on the surface of the shielding plate 100 installed outside the induction coil 50 and that the electromagnetic induction from the induction coil 50 to the outside of the shielding plate 100 is shielded.

Figure 6:
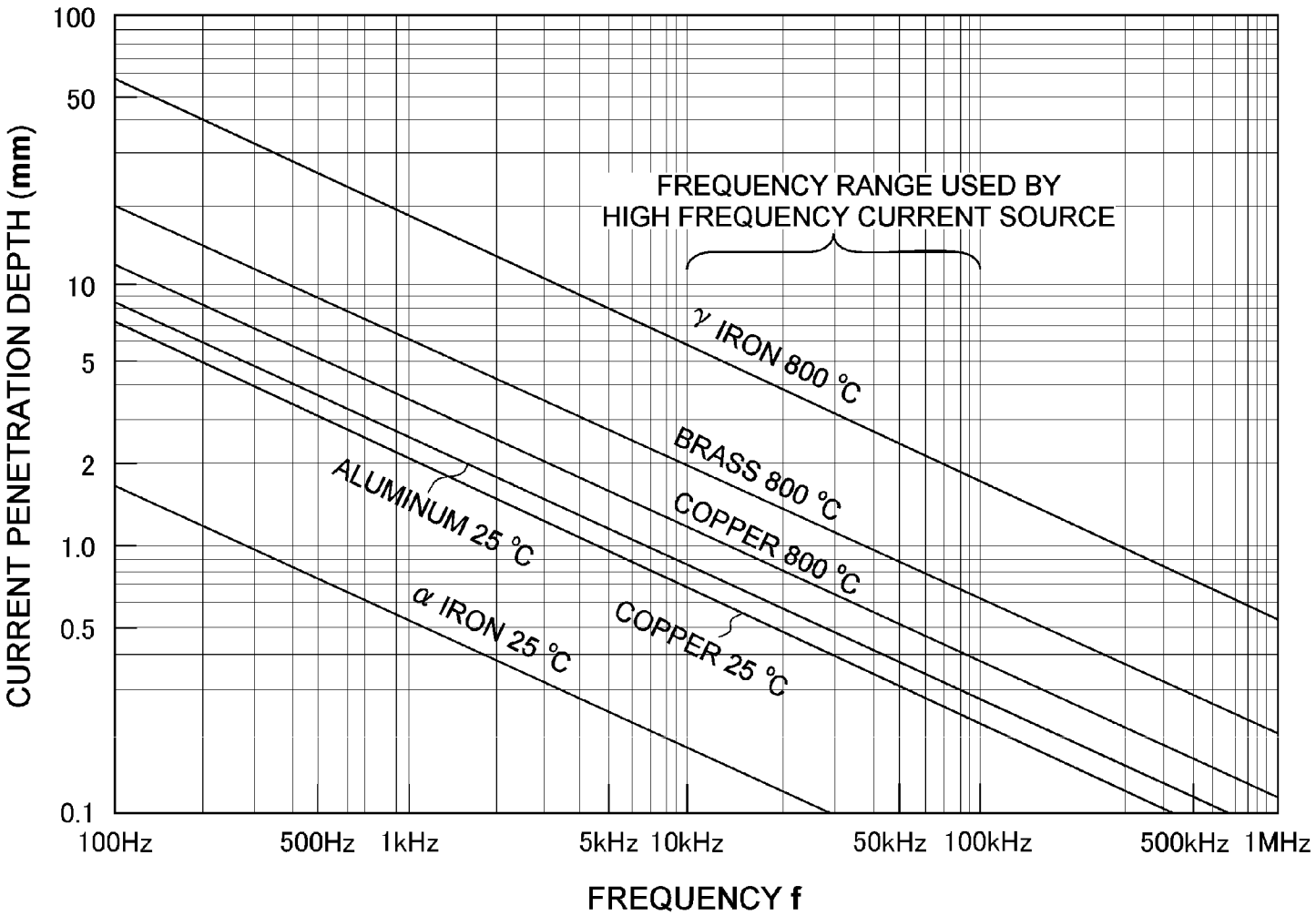
FIG. 6 is a graphical diagram exemplifying current penetration depths of conductive members constituting a shielding plate 100.

Preferably, a thickness of the shielding plate 100 according to the embodiment may be at least two times greater than a current penetration depth of a conductive material constituting the shielding plate 100. FIG. 6 is a graphical diagram exemplifying current penetration depths of conductive members constituting the shielding plate 100. When the shielding plate 100 is made of copper (Cu) having a current penetration depth of 0.6 mm, the thickness of the shielding plate 100 is 1.2 mm or more, and preferably 2.4 mm or more. Therefore, when an alternating current flows through the induction coil 50, it can be ensured that the induction current flows on the surface of the shielding plate 100 installed outside the induction coil 50 and that the electromagnetic induction from the induction coil 50 to the outside of the shielding plate 100 is shielded. For example, even when a gap is exists at a joint of the shielding plate 100, a path (an eddy-shaped path) of the induction current that flows from an inner surface (the side of the induction coil 50) to an outer surface (the outside of the shielding plate 100) of the shielding plate 100 may be secured by setting the thickness of the shielding plate 100 to the above-described thickness. Therefore, it can be ensured that the induction current flows on the surface of the shielding plate 100 installed outside the induction coil 50 and that the electromagnetic induction from the induction coil 50 to the outside of the shielding plate 100 is shielded. In addition, when the induction current flows on the surface of the shielding plate 100, but the thickness of the shielding plate 100 is less than the above-described thickness range (for example, the same thickness as the current penetration depth), a gap is formed at the joint of the shielding plate 100. Therefore, a path (an eddy-shaped path) of the induction current that flows from an inner surface (the side of the induction coil 50) to an outer surface (the outside of the shielding plate 100) of the shielding plate 100 may not be secured, and it cannot be ensured that the electromagnetic induction from the induction coil 50 to the outside of the shielding plate 100 is shielded.

Further, the shielding plate 100 according to the embodiment includes a cooling mechanism 101 for cooling the shielding plate 100 by supplying a cooling medium (coolant, etc.) thereto. By cooling the shielding plate 100 using the cooling mechanism 101, an increase in temperature of the shielding plate 100 due to the induction current flowing through the shielding plate 100 is suppressed, and a temperature of the shielding plate 100 may be maintained at a temperature of, for example, 25° C. to 100° C. As a result, the substrate processing apparatus may be operated safely. In general, the shielding plate 100 and the cooling mechanism 101 constitute the shielding unit according to the embodiment.

[Surrounding Structure of Processing Furnace 40]

FIG. 5 is a diagram schematically illustrating the processing furnace 40 and a surrounding structure thereof according to the first embodiment of the present invention. As shown in FIG. 5, a load lock chamber 110 serving as a preliminary chamber is installed under the processing furnace 40. A boat elevator 115 is installed on an outer surface of a sidewall constituting the load lock chamber 110. The boat elevator 115 includes a lower base plate 112, a guide shaft 116, a ball screw 118, an upper base plate 120, an elevation motor 122, an elevation base plate 130 and a bellows 128. The lower base plate 112 is horizontally fixed to the outer surface of the sidewall constituting the load lock chamber 110. The guide shaft 116 engaged with an elevation stage 114 and the ball screw 118 screw-coupled to the elevation stage 114 is vertically installed on the lower base plate 112. The upper base plate 120 is horizontally fixed to upper ends of the guide shaft 116 and the ball screw 118. The ball screw 118 is configured to rotate by means of the elevation motor 122 installed in the upper base plate 120. The guide shaft 116 is configured to allow vertical movement of the elevation stage 114 and prevent horizontal rotation of the elevation stage 114. The elevation stage 114 can be raised and lowered by rotating the ball screw 118.

A hollow elevation shaft 124 is vertically fixed to the elevation stage 114. A connection unit between the elevation stage 114 and the elevation shaft 124 is air-tightly provided. The elevation shaft 124 is configured to be lifted and lowered together with the elevation stage 114. A lower portion end of the elevation shaft 124 penetrates through a top plate 126 constituting the load lock chamber 110. An inner diameter of a through hole disposed in the top plate 126 of the load lock chamber 110 is greater than an outer diameter of the elevation shaft 124 so that the elevation shaft 124 is prevented from coming into contact with the top plate 126. As the hollow elastic body having elasticity, the bellows 128 is installed between the load lock chamber 110 and the elevation stage 114 so as to cover surroundings of the elevation shaft 124. Each of a connection unit between the elevation stage 114 and the bellows 128 and a connection unit between the top plate 126 and the bellows 128 is air-tightly provided, and is configured to maintain air-tight state of the inside of the load lock chamber 110. The bellows 128 has sufficient elasticity to correspond to an elevation level of the elevation stage 114. An inner diameter of the bellows 128 is sufficiently greater than an outer diameter of the elevation shaft 124 so that the elevation shaft 124 is prevented from coming into contact with the bellows 128.

The elevation base plate 130 is horizontally fixed to a lower end of the elevation shaft 124 protruding from the inside of the load lock chamber 110. A connection unit between the elevation shaft 124 and the elevation base plate 130 is air-tightly provided. A seal cap 219 is air-tight installed via a seal member such as an O-ring on a top surface of the elevation base plate 130. The seal cap 219 is, for example, made of a metal such as stainless steel, and has a disc shape. As the elevation stage 114, the elevation shaft 124, the elevation base plate 130, and the seal cap 219 are elevated by driving the elevation motor 122 to rotate the ball screw 118, the boat 30 is loaded (boat-loaded) into the reaction chamber 44, and an opening (a furnace port) of the processing furnace 40 is simultaneously closed by the seal cap 219. In addition, as the elevation stage 114, the elevation shaft 124, the elevation base plate 130, and the seal cap 219 are lowered by driving the elevation motor 122 to rotate the ball screw 118, the boat 30 is unloaded (boat-unloaded) from the reaction chamber 44. A drive controller 108 is electrically connected to the elevation motor 122. The drive controller 108 controls the boat elevator 115 such that the boat elevator 115 performs a desired operation at a desired time point.

A drive unit cover 132 is air-tightly installed on a lower surface of the elevation base plate 130 via a seal member such as an O-ring. A drive unit accommodating case 140 includes the elevation base plate 130 and the drive unit cover 132. An inside of the drive unit accommodating case 140 is separated from an inner atmosphere of the load lock chamber 110. A rotary mechanism 104 is installed inside the drive unit accommodating case 140. A power supply cable 138 is connected to the rotary mechanism 104. The power supply cable 138 is configured to extend from an upper end of the elevation shaft 124 through the elevation shaft 124 to the rotary mechanism 104, and to supply electric power to the rotary mechanism 104. An upper end portion of a rotating shaft 106 provided in the rotary mechanism 104 passes through the seal cap 219, and is configured to support the boat 30 serving as a substrate holding mechanism from a lower portion thereof. The wafer 14 held by the boat 30 may be rotated inside the reaction chamber 44 by operating the rotary mechanism 104. A drive controller 108 is electrically connected to the rotary mechanism 104. The drive controller 108 controls the rotary mechanism 104 such that the rotary mechanism 104 performs a desired operation at a desired time point.

Also, a cooling mechanism 136 is installed in the vicinity of the rotary mechanism 104 in the drive unit accommodating case 140. Cooling passages **140*a* are formed in the cooling mechanism 136 and the seal cap 219. A coolant pipe 142 for supplying coolant is connected to the cooling passages 140*a*. The coolant pipe 142 is configured to extend from the upper end of the elevation shaft 124 to the cooling passages 140*a* through the elevation shaft 124, and thus supply the coolant to each of the cooling passages 140*a***.

(Controller)

FIG. 4 is a block configuration diagram of a controller 152 serving as a control unit for controlling an operation of each part of the substrate processing apparatus 10. The controller 152 includes a main controller 150, a temperature controller 52 electrically connected to the main controller 150, a gas flow rate controller 78, a pressure controller 98, and a drive controller 108. The main controller 150 includes a manipulation unit and an input/output unit.

(2) Substrate Processing Process

Next, as one process of the method of manufacturing a semiconductor device using above-described substrate processing apparatus 10, a method of epitaxially growing, for example, a SiC film on a substrate such as the wafer 14 made of SiC will be described. In the following description, operations of each part constituting the substrate processing apparatus 10 are controlled by the controller 152.

First, the pod 16 accommodating the plurality of wafers 14 is placed on the pod stage 18. The pod 16 is transferred from the pod stage 18 to the pod placement shelf 22 using the pod transfer device 20. The pod 16 placed on the pod placement shelf 22 is transferred to the pod opener 24 by the pod transfer device 20. A lid of the pod 16 is opened by the pod opener 24, and the number of the wafers 14 accommodated in the pod 16 is detected by the wafer count detector 26.

Next, the wafers 14 are extracted from the pod 16 and transferred to the boat 30 using the wafer transfer machine 28.

When the plurality of wafers 14 are charged into the boat 30, the boat 30 holding the plurality of wafers 14 is loaded (boat-loaded) into the reaction chamber 44 by an elevation operation of the elevation stage 114 and the elevation shaft 124 by the elevation motor 122. Here, the seal cap 219 is used to seal a lower end of the manifold 43 via an O-ring.

The reaction chamber 44 is vacuum-exhausted by the vacuum pump 220 such that the inner pressure of the reaction chamber 44 can reach a predetermined pressure (a degree of vacuum). In this case, the inner pressure of the reaction chamber 44 is measured by a pressure sensor, and the APC valve 214 communicating with the first gas exhaust port 231*a* and the second gas exhaust port 232*a* is feedback-controlled based on measured pressure information. In addition, an alternating electric power of 10 to 100 kHz and 10 to 200 kW is supplied, for example, from the alternating power source (not shown) to the induction coil 50, and an alternating magnetic field is applied to the object 48 to be heated to allow the induction current to flow through the object 48 to be heated, and thus allowing the object 48 to be heated to radiate heat. Thereafter, the wafer 14 held by the boat 30 and the inside of the reaction chamber 44 are, for example, heated to a temperature range of 1500° C. to 1800° C. by radiation generated from the object 48 to be heated. In this case, the power supplied to the induction coil 50 is feedback-controlled based on temperature information detected by the temperature sensor, so that the inside of the reaction chamber 44 can have a predetermined temperature distribution. In addition, when an alternating current flows through the induction coil 50, a cooling medium is supplied to the shielding plate 100 by means of the cooling mechanism 101 to cool the shielding plate 100, and a temperature of the shielding plate 100 is maintained at the temperature of, for example, 25° C. to 100° C. Subsequently, the boat 30 and the wafer 14 are rotated by the rotary mechanism 218.

The valves 261*c* and 262*c* are opened to supply the $SiH_4$ gas serving as the Si-containing gas and the HCl gas serving as the chlorine-containing gas, the flow rates of which are controlled by the MFCs 261*b* and 262*b*, from the first gas supply holes 60*a* into the reaction chamber 44. In this case, the valves 271*c* and 272*c* are also opened to supply the $C_3H_8$ gas, serving as the carbon-containing gas and the $H_2$ gas serving as the hydrogen-containing gas, the flow rates of which are controlled by the MFCs 271*b* and 272*b*, from the second gas supply holes 70*a* into the reaction chamber 44. The $SiH_4$ gas, the HCl gas, the $C_3H_8$ gas and the $H_2$ gas supplied into the reaction chamber 44 pass through the object 48 to be heated in the reaction chamber 44, flow parallel to the wafer 14, and are exhausted through the first gas exhaust port 231*a*. As a result, the entirety of the wafers 14 are effectively and uniformly exposed to the gas, and the SiC film is epitaxially grown on surfaces of the wafers 14.

The valve 280*c* is also opened to supply the Ar gas serving as the inert gas, the flow rate of which is controlled by the MFC 280*b*, from the third gas supply hole 80*a* into the reaction chamber 44. The Ar gas supplied into the reaction chamber 44 flows between the reaction tube 42 and the insulation material 54 and is exhausted through the second gas exhaust port 232*a*. Therefore, the Si-containing gas, the carbon-containing gas, the chlorine-containing gas and a mixture gas thereof are prevented from penetrating a space between the reaction tube 42 and the insulation material 54, and the attachment of unnecessary products to the inner wall of the reaction tube 42 and the outer wall of the insulation material 54 may be prevented.

When the SiC film having a desired film thickness is epitaxially grown with time, the valves 261*c*, 262*c*, 271*b* and 272*b* are closed to stop the supply of the $SiH_4$ gas, the HCl gas, the $C_3H_8$ gas, and the $H_2$ gas into the reaction chamber 44. Thereafter, the inert gas is supplied from the inert gas supply source (not shown) into an inner portion of the object 48 to be heated to substitute the inner portion of the object 48 to be heated with the inert gas, and also to return the inner pressure of the reaction chamber 44 to an atmospheric pressure.

Thereafter, the seal cap 219 is lowered by the elevation motor 122 to open the lower end of the manifold 43, and the boat 30 holding the processed wafers 14 is unloaded (boat-unloaded) from the reaction tube 42 through the lower end of the manifold 43. Thereafter, the boat 30 waits in a predetermined position until all the wafers 14 supported by the boat 30 are cooled. When the wafers 14 in the waiting boat 30 are cooled to a predetermined temperature, the wafers 14 are extracted from the boat 30 using the wafer transfer machine 28, and transferred to and accommodated in a void pod 16 set in the pod opener 24. Thereafter, the pod 16 accommodating the wafers 14 is transferred to the pod placement shelf 22 or the pod stage 18 by the pod transfer device 20. As described above, the series of operations of the substrate processing apparatus 10 is completed.

(3) Effects According to the Embodiment

The embodiment has one or more following effects.

(a) According to the embodiment, the shielding plate 100 having the column shape or the prism shape for surrounding an outer circumference of the induction coil 50 is installed outside the induction coil 50. The shielding plate 100 is made of conductive material such as Cu. The shielding plate 100 suppresses the flow of the induction current through the conductive member such as the screw and the nut provided in the housing 12 installed outside the shielding plate 100 when the alternating current flows through the induction coil 50. That is, by enabling the induction current to strongly flow through a surface of the shielding plate 100 installed outside the induction coil 50 when an alternating current flows through the induction coil 50, the electromagnetic induction at the outside of the shielding plate 100 may be shielded. As a result, the increase in temperature of such members may be suppressed, and safety may be enhanced.

(b) According to the embodiment, the shielding plate 100 may be integrally installed without a gap to surround the outside of the induction coil 50. Therefore, when the alternating current flows through the induction coil 50, it can be ensured that the induction current flows on the surface of the shielding plate 100 installed outside the induction coil 50 and that the electromagnetic induction from the induction coil 50 to the outside of the shielding plate 100 is shielded.

(c) The thickness of the shielding plate 100 according to the embodiment may be at least two times greater than the current penetration depth of the conductive material constituting the shielding plate 100. More particularly, when the shielding plate 100 is made of Cu having the current penetration depth of 0.6 mm, the thickness of the shielding plate 100 is 1.2 mm or more, and preferably 2.4 mm or more. Therefore, when the alternating current flows through the induction coil 50, it can be ensured that the induction current flows on the surface of the shielding plate 100 installed outside the induction coil 50 and that the electromagnetic induction from the induction coil 50 to the outside of the shielding plate 100 is shielded. For example, even when the gap is exists at the joint of the shielding plate 100, the path (the eddy-shaped path) of the induction current that flows from the inner surface (the side of the induction coil 50) to the outer surface (the outside of the shielding plate 100) of the shielding plate 100 may be secured by setting the thickness of the shielding plate 100 to the above-described thickness. Therefore, it can be ensured that the induction current flows on the surface of the shielding plate 100 installed outside the induction coil 50 and that the electromagnetic induction from the induction coil 50 to the outside of the shielding plate 100 is shielded.

(d) According to the embodiment, when the alternating current flows through the induction coil 50, the shielding plate 100 is cooled by supplying the cooling medium to the shielding plate 100 by the cooling mechanism 101. As a result, even when the induction current flows in the shielding plate 100, the increase in temperature of the shielding plate 100 may be suppressed. Therefore, the safety may be enhanced.

(e) According to the embodiment, the $SiH_4$ gas and the HCl gas are supplied from the first gas supply nozzle 60, and the $C_3H_8$ gas and the $H_2$ gas are supplied from the second gas supply nozzle 70. Therefore, reaction of the gases in the first gas supply nozzle 60 and the second gas supply nozzle 70 may be prevented, and formation of a deposit film in the first gas supply nozzle 60 and the second gas supply nozzle 70 may be suppressed.

(f) According to the embodiment, the waste of the gases in the first gas supply nozzle 60 and the second gas supply nozzle 70 may be suppressed, and uniform epitaxial growth of the SiC film in upstream and downstream sides in the reaction chamber 44 may be performed.

(g) According to the embodiment, the waste of the source gas in the first gas supply nozzle 60 and the second gas supply nozzle 70 may be suppressed, and clogging of the first gas supply nozzle 60 and the second gas supply nozzle 70 caused by the growth of the deposit film may be suppressed.

(h) According to the embodiment, waste of the source gas in the first gas supply nozzle 60 and the second gas supply nozzle 70 may be prevented, and an increase in particles in the reaction chamber 44 or attachment of the particles to the wafer 14 caused by delamination or separation of a deposit in the gas supply nozzles may be suppressed.

(i) According to a substrate processing apparatus, a method of manufacturing a semiconductor device and a method of manufacturing a substrate of the present invention, an induction heating of metal members installed outside an induction heating unit can be suppressed, and safety can be improved during processing of the substrate. Furthermore, the substrate processing apparatus, the method of manufacturing a semiconductor device, and the method of manufacturing a substrate capable of preventing leakage of a gas from a reaction chamber are be provided.

Other Embodiments of the First Embodiment of the Present Invention

While the present invention has been described in detail with reference to the embodiments thereof, the present invention is not limited to the above-described embodiments and changes may be made thereto without departing from the scope of the invention.

Although Cu, for example, is used as the material for the shielding plate 100, aluminum (Al), brass, iron or alloys thereof may be used. Further, the shielding plate 100 may be made of a single material, and may also be made of a composite material including a conductive material and a non-conductive material. Moreover, although the shielding plate 100 having the column shape or the prism shape is exemplified, the shielding plate 100 may have an arbitrary shape such as a hemisphere.

Although the example wherein single first gas supply nozzle 60, single second gas supply nozzle 70 and single third gas supply nozzle 80 are installed is exemplified, the present invention is not limited thereto. A plurality of first gas supply nozzles 60, a plurality of second gas supply nozzles 70, and a plurality of third gas supply nozzles 80 may also be installed. Further, although the example wherein the Si-containing gas and the chlorine-containing gas are supplied from the first gas supply nozzle 60, and the carbon-containing gas and the reduction gas are supplied from the second gas supply nozzle 70 is exemplified, gas supply nozzle may be installed for each of gases.

Although the $SiH_4$ gas is exemplified as the Si-containing gas, a disilane ($Si_2H_6$) gas and a trisilane ($Si_3H_8$) gas may be used instead. Further, although the HCl gas is exemplified as the chlorine-containing gas, other halogen gases such as a chlorine ($Cl_2$) gas may be used instead. Moreover, the present invention is not limited to the example wherein the Si-containing gas is mixed with the chlorine-containing gas. A gas containing Si and chlorine, for example, a etrachlorosilane ($SiCl_4$) gas, a trichlorosilane (generally referred to as "TCS," $SiHCl_3$) gas, or a dichlorosilane (generally referred to as "DCS," $SiH_2Cl_2$) gas may be supplied into the reaction chamber 44.

Although the $C_3H_8$ gas is exemplified as the carbon-containing gas, other carbon-containing gases such as an ethylene ($C_2H_4$) gas and an acetylene ($C_2H_2$) gas may be used instead.

Although the $H_2$ gas is exemplified as the reduction gas, a combination of the hydrogen-containing gas, at least one of rare gases such as an Ar gas, an helium (He) gas, a neon (Ne) gas, a krypton (Kr) gas, and a xenon (Xe) gas, or at least one of $H_2$ gas, the hydrogen-containing gas, and the above-described rare gas may be supplied.

Although, the Ar gas serving as the rare gas is exemplified as the inert gas, the He gas, the Ne gas, the Kr gas and the Xe gas may be used herein.

Preferred Embodiments of the First Embodiment of the Present Invention

Hereinafter, preferred embodiments of the first embodiment of the present invention will be described in further detail.

According to one aspect of the first embodiment of the present invention, there is provided a substrate processing apparatus including:

a reaction tube for accommodating a substrate;

an induction heating unit installed to surround an outer circumference of the reaction tube;

a shielding unit installed to surround an outside of the induction heating unit;

a gas supply unit for supplying at least a source gas into the reaction tube; and a controller for processing the substrate by heating an inside of the reaction tube using the induction heating unit, and supplying at least the source gas from the gas supply unit into the reaction tube.

According to another aspect of the first embodiment of the present invention, there is provided a method of manufacturing a semiconductor device including steps of:

loading a substrate into a reaction tube;

heating an inside of the reaction tube using an induction heating unit surrounded by a shielding unit and installed to surround an outside of the reaction tube;

processing the substrate by supplying at least a source gas from a gas supply unit into the reaction tube; and unloading the substrate from the reaction tube.

According to still another aspect of the first embodiment of the present invention, there is provided a method of manufacturing a substrate including steps of:

loading a substrate into a reaction tube;

heating an inside of the reaction tube using an induction heating unit surrounded by a shielding unit and installed to surround an outside of the reaction tube;

processing the substrate by supplying at least a source gas from a gas supply unit into the reaction tube; and unloading the substrate from the reaction tube.

Preferably, the shielding unit includes a cooling mechanism for cooling the shielding unit by supplying a cooling medium to the shielding unit.

Preferably, a thickness of the shielding unit is at least two times greater than a current penetration depth value of a material constituting the shielding unit.

According to yet another aspect of the first embodiment of the present invention, there is provided a substrate processing apparatus including:

a reaction tube having a processing chamber provided therein to process a substrate;

an heating unit including an induction coil surrounding the processing chamber;

a shielding unit installed to surround an outside of the induction heating unit;

a gas supply unit for supplying at least a source gas into the reaction tube; and a controller for processing the substrate by heating an inside of the reaction tube using the induction heating unit, and supplying at least the source gas from the gas supply unit into the reaction tube, wherein the shielding unit surrounds the outside of the induction heating unit without a gap.

According to another aspect of the first embodiment of the present invention, there is provided a substrate processing apparatus including:

a reaction tube having a processing chamber provided therein to process a substrate;

an heating unit including an induction coil surrounding the processing chamber;

a shielding plate made of a conductive material installed to surround an outside of the induction heating unit;

a gas supply unit for supplying at least a source gas into the reaction tube; and a controller for processing the substrate by heating an inside of the reaction tube using the induction heating unit, and supplying at least the source gas from the gas supply unit into the reaction tube, wherein a thickness of the shielding plate is at least two times greater than a current penetration depth of the conductive material constituting the shielding plate.

Preferably, the shielding plate includes a cooling mechanism for cooling the shielding plate by supplying a cooling medium to the shielding plate.

According to still another aspect of the first embodiment of the present invention, there is provided a method of manufacturing a semiconductor device, including steps of:

loading a substrate into a reaction tube;

heating an inside of the reaction tube by allowing an alternating current to flow through an induction coil installed to surround an outside of the reaction tube;

processing the substrate by supplying at least a source gas from a gas supply unit into the reaction tube; and unloading the substrate from the reaction tube, wherein a shielding plate is installed to surround an outside of the induction coil without a gap.

According to yet another aspect of the first embodiment of the present invention, there is provided a method of manufacturing a semiconductor device, including steps of:

loading a substrate into a reaction tube;

heating an inside of the reaction tube by allowing an alternating current to flow through an induction coil installed to surround an outside of the reaction tube;

processing the substrate by supplying at least a source gas from a gas supply unit into the reaction tube; and unloading the substrate from the reaction tube, wherein a thickness of a shielding plate is at least two time greater than a current penetration depth of a conductive material constituting the shielding plate.

According to yet another aspect of the first embodiment of the present invention, there is provided a method of manufacturing a substrate, including steps of:

loading a substrate into a reaction tube;

heating an inside of the reaction tube by allowing an alternating current to flow through an induction coil installed to surround an outside of the reaction tube;

processing the substrate by supplying at least a source gas from a gas supply unit into the reaction tube; and unloading the substrate from the reaction tube, wherein a shielding plate is installed to surround an outside of the induction coil without a gap.

According to yet another aspect of the first embodiment of the present invention, there is provided a method of manufacturing a substrate, including steps of:

loading a substrate into a reaction tube;

heating an inside of the reaction tube by allowing an alternating current to flow through an induction coil installed to surround an outer circumference of the reaction tube;

processing the substrate by supplying at least a source gas from a gas supply unit into the reaction tube;

unloading the substrate from the reaction tube, wherein a thickness of the shielding plate is at least two time greater than a current penetration depth of a conductive material constituting the shielding plate.

Preferably, the shielding plate is made of copper, and the thickness of the shielding plate is at least 1.2 mm or more.

Also preferably, the shielding plate is cooled by supplying a cooling medium to the shielding plate using a cooling mechanism.

Second Embodiment

Next, an embodiment used to solve the second disadvantage will be described.

Figure 9:
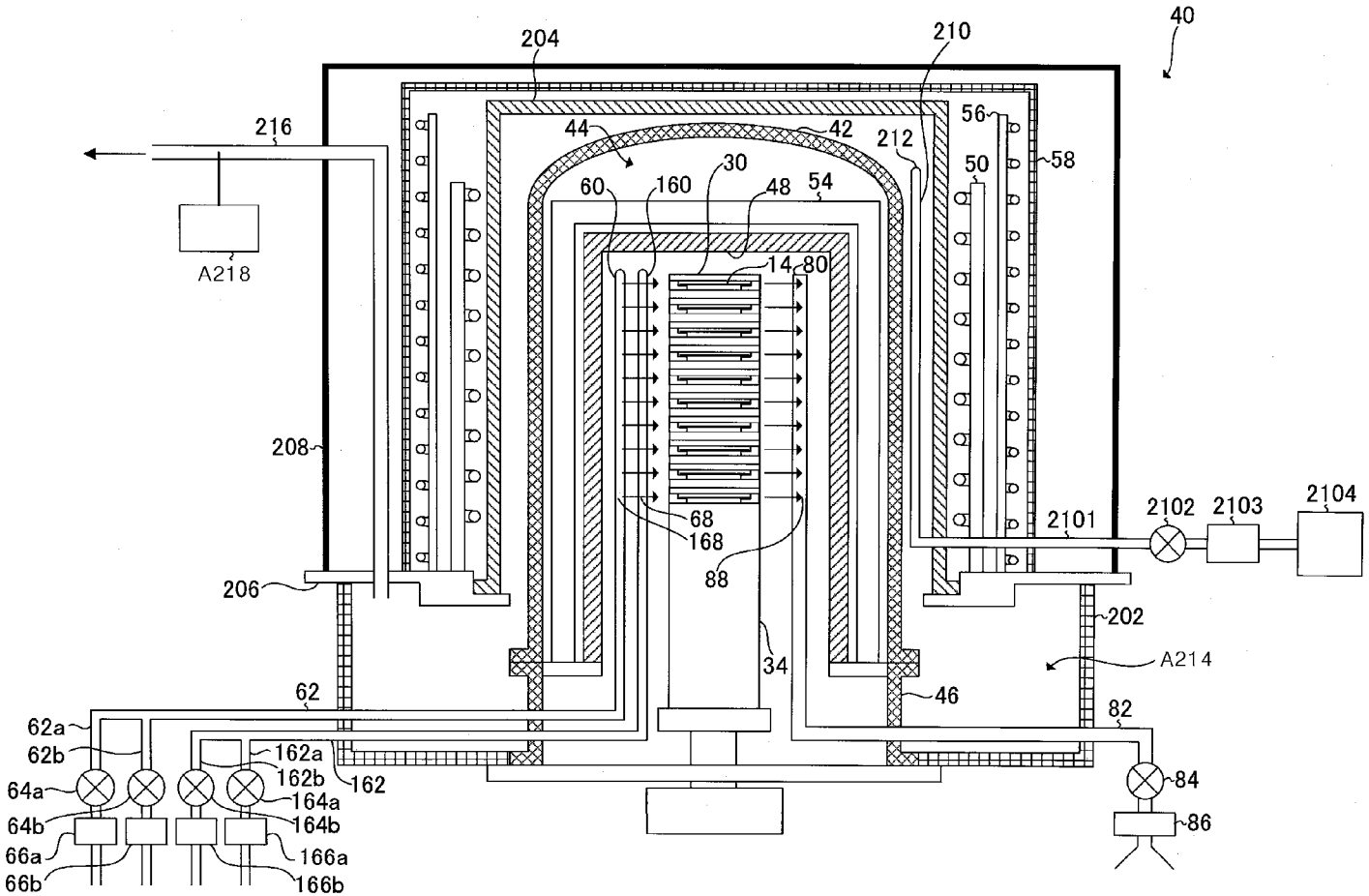
FIG. 9 is a lateral cross-sectional view illustrating a processing furnace used in a second embodiment of the present invention.
Figure 10:
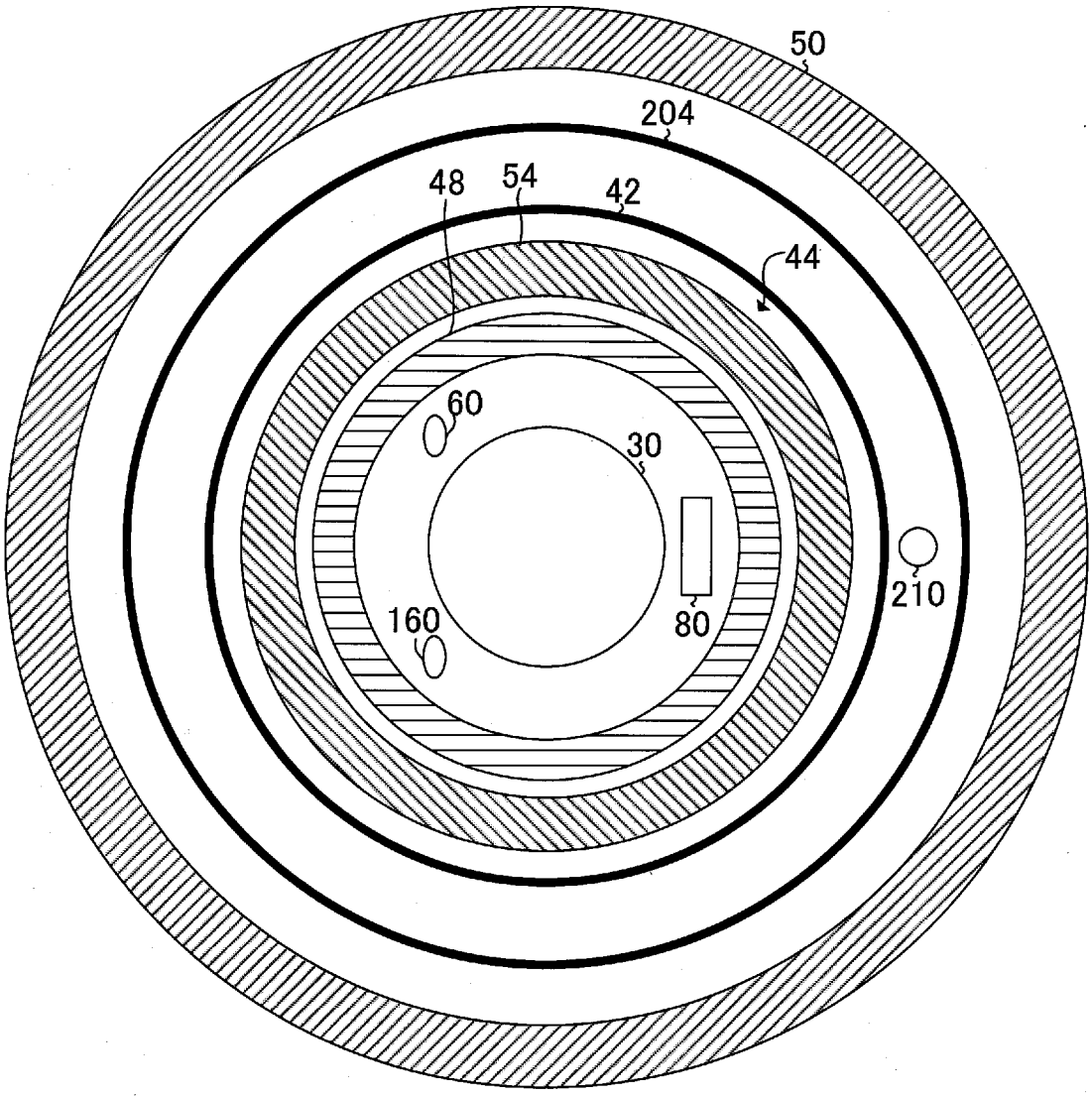
FIG. 10 is a top cross-sectional view of a central region of the processing furnace used in the second embodiment of the present invention.
Figure 11:
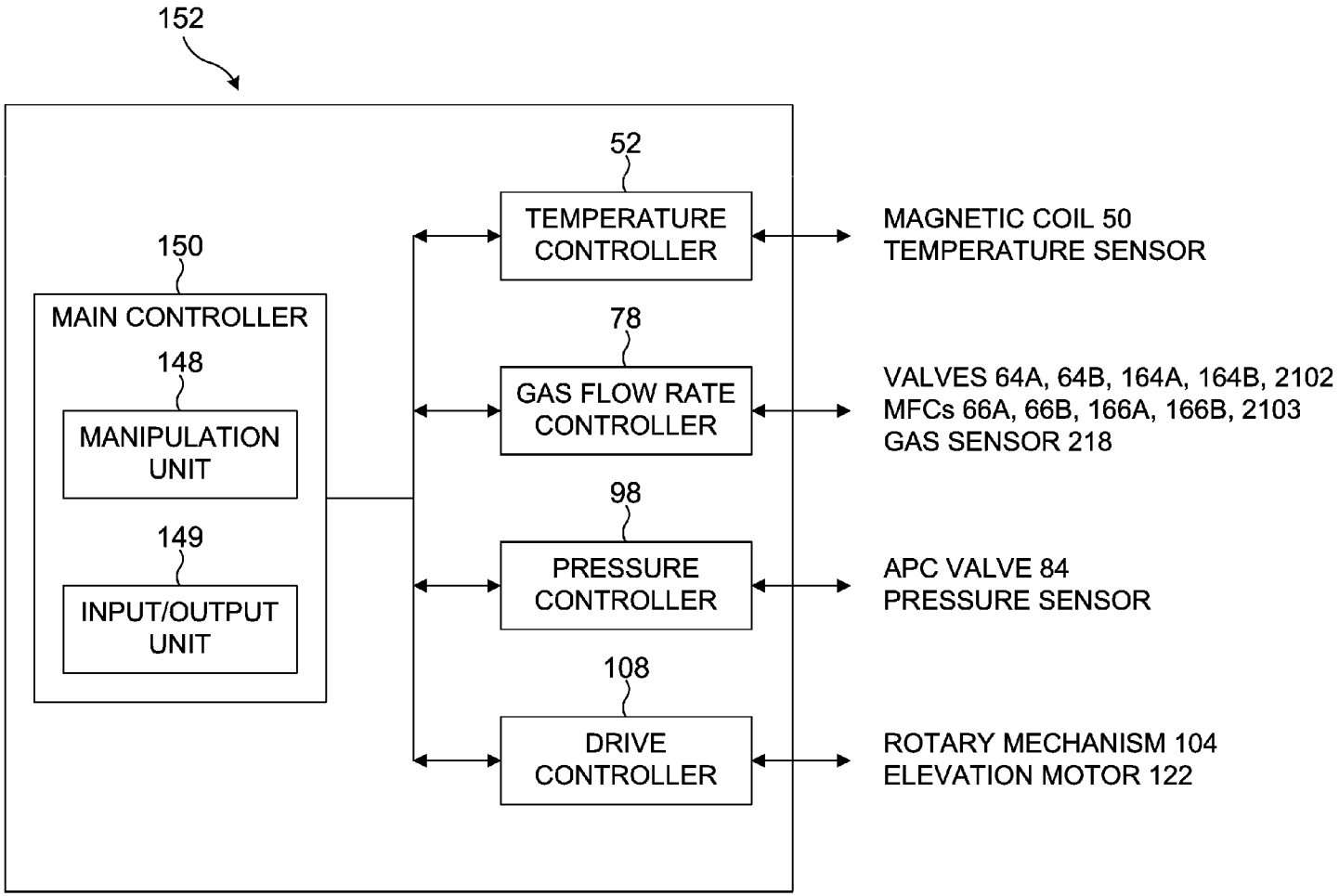
FIG. 11 is a block diagram illustrating a controller of a thermal processing apparatus to which the second embodiment of the present invention is applied.

Descriptions of the same parts as those of the first embodiment will be omitted, and parts different from those of the first embodiment will be described in detail. FIG. 9 is a lateral cross-sectional view of a processing furnace 40 according to a second embodiment, and FIG. 10 is a top cross-sectional view of a central region of the processing furnace 40. FIG. 11 is a block diagram of a controller.

According to the second embodiment, a scavenger 202 serving as a cover is installed outside a manifold 46 to surround a first opening installed at a lower end of a manifold 46 and a second opening installed at a lower end of a liner tube 204. The scavenger 202 blocks a transfer chamber, in which the wafer transfer machine 28 and the like are installed, from the processing furnace 40.

As the accommodation tube for preventing a leakage of a gas such as $H_2$ introduced into the processing chamber 44, the liner tube 204 is installed between an outer tube 42 and a magnetic coil 50. The liner tube 204 is made of a heat-resistant material such as quartz ($SiO_2$) and SiC, and has a cylindrical shape with upper end thereof closed and lower end thereof open. The processing chamber 44 and the outer tube 42 are accommodated in a cylindrical hollow portion in the inside of the liner tube 204. As described above, the outside of the processing chamber 44 is dually protected by the outer tube 42 and the liner tube 204, and the processing furnace 40 is configured to cope with an explosion.

A heater base 206 is installed at a lower portion of the liner tube 204, and the liner tube 204, the magnetic coil 50 and an outer insulation wall 56 are supported by the heater base 206. As a magnetic field leakage protection unit for preventing a magnetic field formed by the magnetic coil 50 from being leaked from the processing furnace 40, a magnetic field seal 58 is installed outside the outer insulation wall 56, and a housing cover 12 of the processing furnace 40 is installed outside the magnetic field seal 58.

As an inert gas supply unit extending in an upward direction of the outer tube 42, an inert gas supply nozzle 210 is installed between the outer tube 42 and the liner tube 204, and an inert gas such as nitrogen ($N_2$) is introduced through the inert gas supply nozzle 210 from the inert gas supply port 212 installed at an upper portion thereof. The inert gas introduced from the inert gas supply nozzle 210, which is disposed outside the outer tube 42, flows from an upper portion to a lower portion of a surrounding space A214 which is provided outside the processing chamber 44 surrounded by the scavenger 202, the liner tube 204 and the manifold 46 to purge the surrounding space A214. $H_2$, which easily stays in the upper portion due to its lightness, may be effectively exhausted by introducing the inert gas from the upper portion.

The inert gas supply nozzle 210 may be installed through a portion lower than the liner tube 204, and may preferably be passed through a lower sidewall of the liner tube 204, and fixed to the lower sidewall. Therefore, a gap for penetrating the inert gas supply nozzle 210 may be eliminated from the lower portion side of the liner tube 204. In addition, a maintenance space much greater than the inert gas supply nozzle 210 required for installing and separating the inert gas supply nozzle 210 may be eliminated. In addition, when the maintenance space is eliminated, a space from which a gas is leaked may be reduced, and a size of the entire apparatus may also be more compact.

An inert gas supply tube 2101 is connected to the inert gas supply nozzle 210. The inert gas supply tube 2101 is connected to a valve 2102 serving as a switching body, an MFC 2103 serving as a mass flow control device, and an inert gas supply source 2104.

An inert gas such as Ar or $N_2$ is introduced into the inert gas supply tube 2101. A gas flow rate controller 78 (see FIG. 11) is electrically connected to the valve 2102 and the MFC 2103, and is configured to control a flow rate of the inert gas to be supplied at a desired time point so that the amount of the inert gas can reach a desired amount.

In addition, an atmospheric (oxygen) concentration in the surrounding space A214 is reduced as the surrounding space A214 including a space surrounded by the scavenger 202 is filled with an inert gas ($N_2$) atmosphere. Therefore, even when $H_2$ leaks from the processing chamber 44 due to a damage of the outer tube 42, the processing furnace 40 prevents reaction of the leaked $H_2$ with oxygen ($O_2$), and cope with an explosion.

An atmosphere and the inert gas in the surrounding space A214 are exhausted through an exhaust duct 216 that is installed in the heater base 206 and communicates with the scavenger 202 serving as a surrounding space exhaust unit or a waste line for exhausting an inner portion of the cover. A gas sensor A218 serving as a gas detector is installed in the exhaust duct 216, and the gas sensor A218 detects the hydrogen element-containing gas or the oxygen element-containing gas, such as $H_2$ and $O_2$, contained in the exhausted gas.

In addition, the gas sensor A218 may be installed independently as a first gas sensor for detecting the hydrogen element-containing gas and a second gas sensor for detecting the oxygen element-containing gas.

The gas sensor A218 is electrically connected to the gas flow rate controller 78, and when the gas sensor A218 detects $H_2$, for example, the gas flow rate controller 78 controls the valves 261*c*, 262*c*, 271*c* and 272*c* and the MFCs 261*b*, 262*b*, 271*b* and 272*b* to stop the supply of the reactive gas such as $H_2$. As a result, leakage of a predetermined gas may be detected, and the supply of the reactive gas to the reaction chamber 44 may also be stopped. In addition, the detection results measured by the gas sensor A218 are output as an alarm or a sign from an input/output unit 149 of the controller 152, which is described later. As a result, when $H_2$ leaks from the processing chamber 44 (the surrounding space A214), the leakage of $H_2$ may be observed from the outside (by an operator, etc.).

The substrate processing step is generally performed in the same manner as in the first embodiment, and the SiC film is epitaxially grown on the surface of the wafer 14. However, in the second embodiment, the inert gas is supplied from the inert gas supply source 2104 to the inert gas supply nozzle 210 via the inert gas supply tube 2101, the MFC 2103, and the valve 2102 prior to processing the wafer 14 in the processing chamber 44. The inert gas introduced from the inert gas supply nozzle 210 into the surrounding space A214 purges the surrounding space A214, and exhausted through the exhaust duct 216. In this case, the gas sensor A218 detects the gas exhausted through the exhaust duct 216.

Preferably, when the inert gas is supplied from the inert gas supply nozzle 210 at a time point at which the inner part of the surrounding space A214 is filled with the inert gas before the $H_2$ gas is supplied from at least the first gas supply nozzle 60 or the second gas supply nozzle 70 into the processing chamber 44, an explosion may be further prevented.

According to the above-described second embodiment, the following effects will be obtained.

1. Since a magnetic field generation unit is used as the heater instead of the resistance heating-type heater, and the inert gas supply unit is used to supply the inert gas into a space between the accommodation tube and the reaction tube, an explosion may be prevented even when the processing gas leaks from the reaction tube.

2. Since the inert gas is supplied from the upper portion of the surrounding space provided between the accommodation tube and the reaction tube, and the inert gas is exhausted from the exhaust line installed in the cover for surrounding a second opening installed at a lower end of the accommodation tube and a first opening installed at the lower end of the accommodation tube, the processing gas may be suppressed from remaining between the accommodation tube and the reaction tube, and leakage of the gas out of the accommodation tube may be prevented since there is no exhaust port installed in the accommodation tube.

Figure 12:
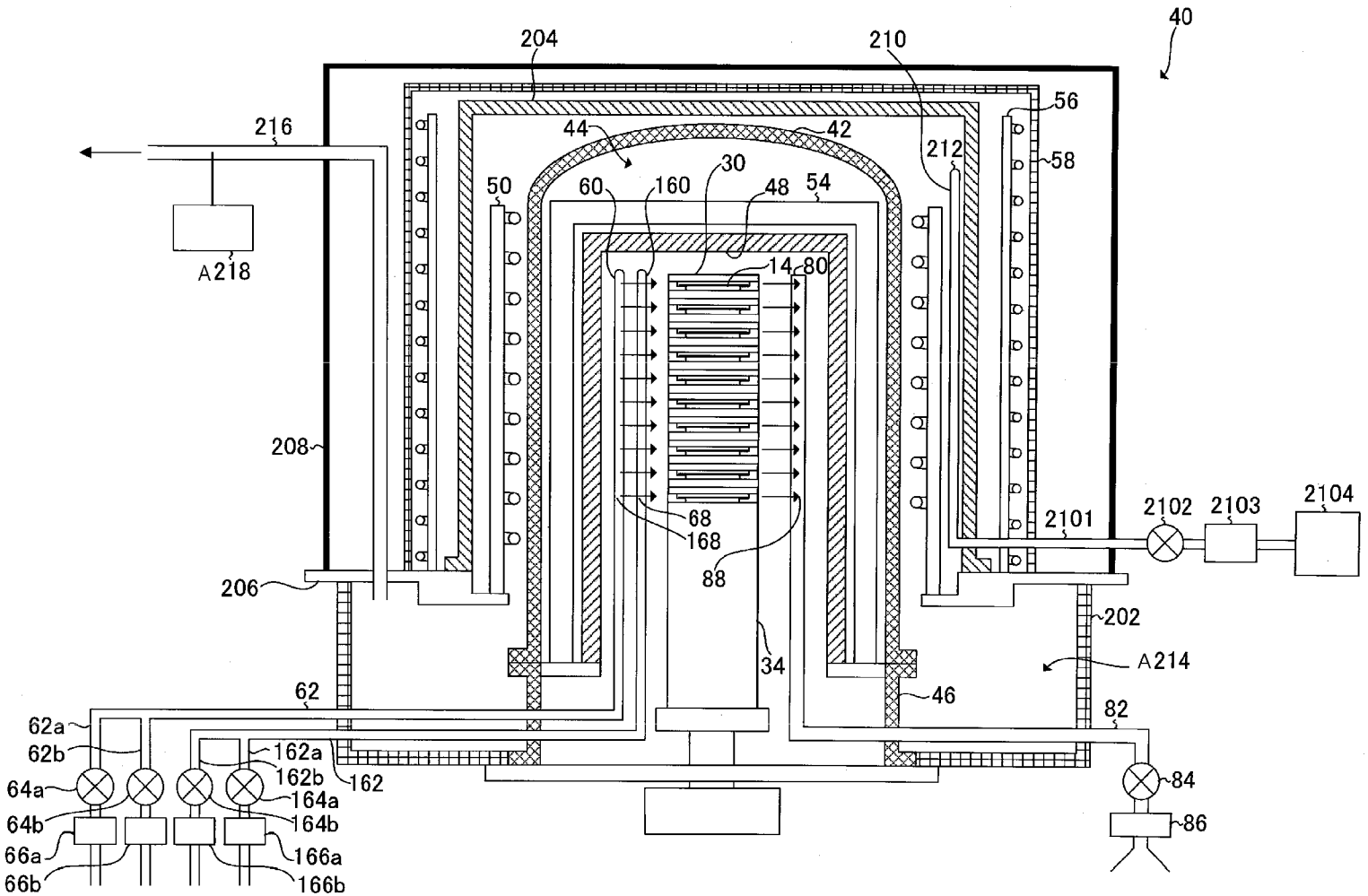
FIG. 12 is a lateral cross-sectional view illustrating another processing furnace used in the second embodiment of the present invention.
Figure 13:
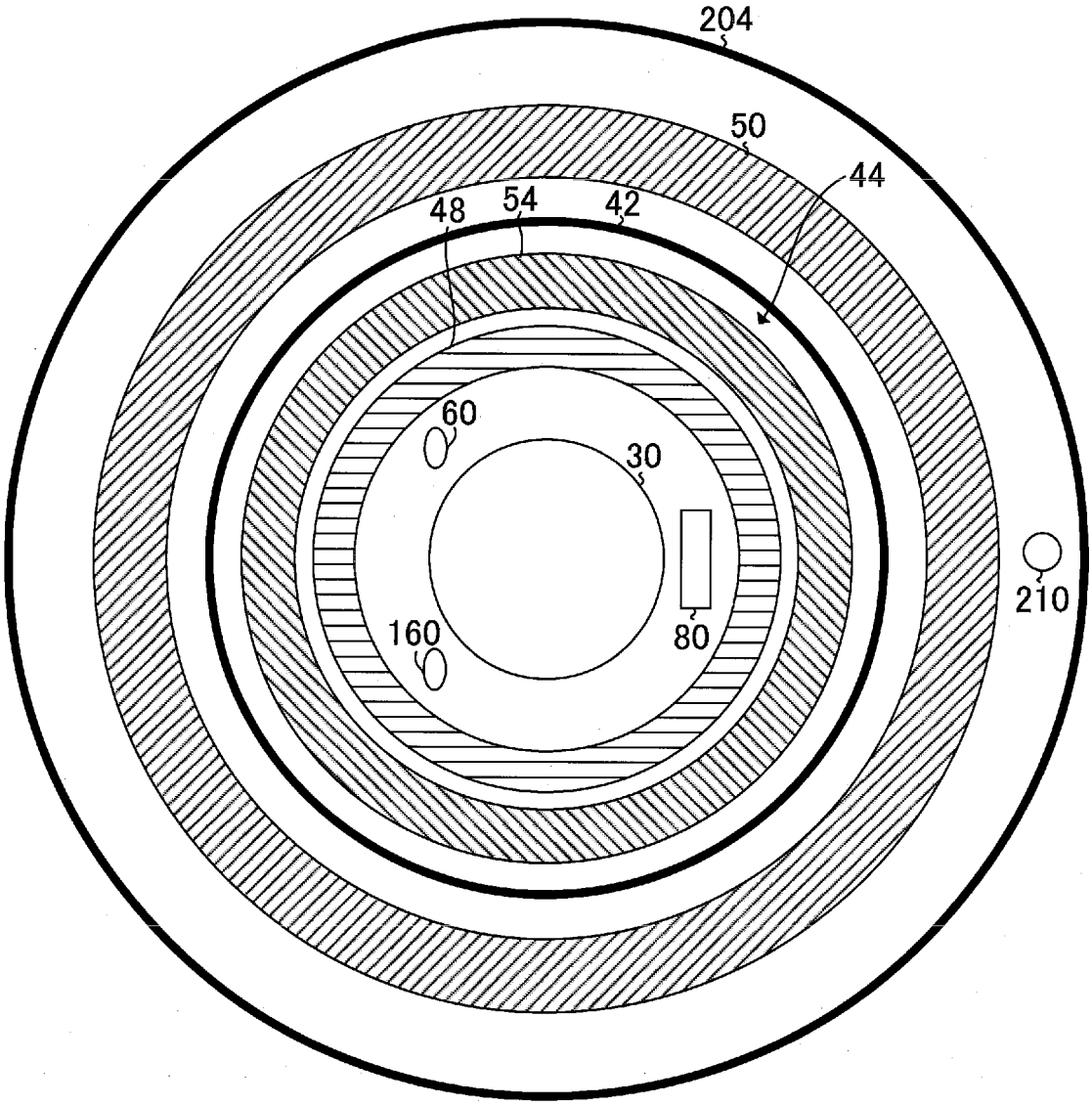
FIG. 13 is a top cross-sectional view of a central region of the other processing furnace used in the second embodiment of the present invention.

Next, a modified embodiment of the second embodiment will be described. FIG. 12 is a lateral cross-sectional view of the processing furnace 40 according to a modified embodiment of the second embodiment, and FIG. 13 is a top cross-sectional view of a central region of the processing furnace 40 according to a modified embodiment of the second embodiment.

While the magnetic coil 50 is disposed outside the liner tube 204 in the above-described configuration, the magnetic coil 50 is disposed in the surrounding space A214 arranged inside the liner tube 204 in the modified embodiment. A feeder line (not shown) of the magnetic coil 50 is, for example, passed through the scavenger 202, and connected to an external radio frequency (RF) power source (not shown).

By disposing the magnetic coil 50 in the surrounding space A214 purged with the inert gas, deterioration of the magnetic coil 50 due to oxidation may be prevented. In addition, since the magnetic coil 50 is cooled by the inert gas, a water cooling apparatus for cooling the magnetic coil 50 need not be installed. In the embodiment, the magnetic coil 50 is also disposed adjacent to a susceptor 48 and the wafer 14 in the processing chamber 44, compared to the magnetic coil 50 disposed outside the liner tube 204, and thus heating efficiency may be improved. In addition, the water cooling apparatus for cooling the magnetic coil 50 need not be installed, but may be installed.

Preferred Aspects of the Second Embodiment of the Present Invention

Hereinafter, preferred aspects of the second embodiment of the present invention will be described in detail.

(1) According to one aspect of the second embodiment of the present invention, there is provided a substrate processing apparatus including: a reaction tube having an inner part configured such that an object to be inducted and a substrate are disposed to process the substrate based on heat energy emitted from the object to be inducted in the inner part of the reaction tube; an inductor disposed outside the reaction tube to induction-heat the object to be inducted; an accommodation tube for accommodating the reaction tube and the inductor; and an inert gas supply unit for supplying an inert gas into a gap formed between the reaction tube and the accommodation tube.

Therefore, leakage of the processing gas may be suppressed, and oxidation of the inductor may be suppressed at the same time. In addition, since the inductor may be disposed closer to the object to be inducted, heating efficiency may be improved.

(2) There is provided the substrate processing apparatus of (1) in which the gap is formed between the reaction tube and the accommodation tube to reach an upper end of the reaction tube and the inert gas supply unit is formed to extend from a lower end to an upper end of the accommodation tube.

Therefore, a combustible gas such as $H_2$ gas may be suppressed from remaining in an upper end of the reaction tube between the reaction tube and the accommodation tube. In particular, since $H_2$ gas as the combustible gas is light in weight, the $H_2$ gas easily stays in the upper end. Therefore, an explosion, spontaneous combustion and the like during leakage may be further suppressed.

(3) There is provided the substrate processing apparatus of (2) in which the inert gas supply unit is installed through a sidewall of the accommodation tube, and the inert gas supply unit is fixed to the sidewall.

Therefore, a gap required to install the inert gas supply unit in a portion lower than the reaction tube may be eliminated, a maintenance space required to install the inert gas need not be installed, and leakage of the gas may be suppressed, and simultaneously a size of the processing furnace (device) may be arranged compactly.

(4) There is provided the substrate processing apparatus of (1) including: a gas supply unit for supplying a hydrogen element-containing gas into the reaction tube; a first opening installed at a lower end of the reaction tube; a second opening installed at a lower end of the accommodation tube; a cover for surrounding the first opening and the second opening; an exhaust line for exhausting an inner part of the cover; a first gas detector installed at the exhaust line to detect the hydrogen element-containing gas; and a second gas detector installed at the exhaust line to detect an oxygen element-containing gas.

Therefore, an explosion, spontaneous combustion and the like during leakage of the hydrogen element-containing gas may be further suppressed, and oxidation of the inductor may be suppressed. In addition, since the inductor may be disposed closer to the object to be inducted, heating efficiency may be improved. Furthermore, the leakage of the hydrogen element-containing gas may be suppressed by the cover, the hydrogen element-containing gas and the oxygen element-containing gas may be detected by the first gas detector and the second gas detector installed at the exhaust line, and safety may be further enhanced.

(5) According to another aspect of the second embodiment of the present invention, there is provided a method of manufacturing a semiconductor device, including steps of: transferring a substrate into a reaction tube disposed inside an inductor, wherein an accommodation tube includes the inductor and the reaction tube accommodated therein; and processing the substrate in the reaction tube, based on heat energy emitted from an object to be induced induction-heated by the inductor, while supplying an inert gas from an inert gas supply unit into a gap formed between the reaction tube and the accommodation tube.

(6) According to another aspect of the second embodiment of the present invention, there is provided a method of processing a substrate, including steps of: transferring a substrate into a reaction tube disposed inside an inductor, wherein an accommodation tube includes the inductor and the reaction tube accommodated therein; and processing the substrate in the reaction tube, based on heat energy emitted from an object to be induced induction-heated by the inductor, while supplying an inert gas from an inert gas supply unit into a gap formed between the reaction tube and the accommodation tube.

(7) According to another aspect of the second embodiment of the present invention, there is provided a method of manufacturing a substrate, including steps of: transferring a substrate into a reaction tube disposed inside an inductor, wherein an accommodation tube includes the inductor and the reaction tube accommodated therein; and processing the substrate in the reaction tube, based on heat energy emitted from the object to be induced induction-heated by the inductor, while supplying an inert gas from an inert gas supply unit into a gap formed between the reaction tube and the accommodation tube.

What is claimed is:

1. A substrate processing apparatus comprising:

a reaction tube having a processing chamber provided therein to process a substrate;

an induction heating unit installed outside of the reaction tube to receive the reaction tube, wherein the induction heating unit is configured to electromagnetically induction-heat the processing chamber by generating a magnetic field;

an accommodation tube installed outside of the induction heating unit to receive the induction heating unit, wherein the accommodation tube encloses the reaction tube and the induction heating unit in an air-tight manner;

a shielding unit made of a conductive material installed to surround an outside of the accommodation tube; and an inert gas supply unit installed in a gap between the reaction tube and the accommodation tube where the induction heating unit is installed, wherein the inert gas supply unit is configured to supply an inert gas into the gap.

2. The substrate processing apparatus according to claim 1, wherein the gap extends to an upper end of the reaction tube between the reaction tube and the accommodation tube, and the inert gas supply unit extends from a lower end to an upper end of the accommodation tube.

3. The substrate processing apparatus according to claim 2, wherein the inert gas supply unit is fixedly installed through a sidewall of the accommodation tube.

4. The substrate processing apparatus according to claim 1, further comprising:

a gas supply unit configured to supply a hydrogen element-containing gas into the reaction tube;

a first opening disposed at a lower end of the reaction tube;

a second opening disposed at a lower end of the accommodation tube;

a cover surrounding the first opening and the second opening;

an exhaust line configured to exhaust an inside of the cover;

a first gas detector installed at the exhaust line to detect the hydrogen element-containing gas; and a second gas detector installed at the exhaust line to detect an oxygen element-containing gas.

5. The substrate processing apparatus according to claim 1, further comprising a housing, wherein the shielding unit is disposed between the housing and the induction heating unit.

6. The substrate processing apparatus according to claim 1, wherein the shielding unit is made of a conductive material having a current penetration depth of less than 0.6 mm when the reaction tube is heated.

7. The substrate processing apparatus according to claim 1, wherein the induction heating unit is operated by an alternating electric power equal to or higher than 10 kHz, and the shielding unit is made of a conductive material having a current penetration depth of less than 0.6 mm when the induction heating unit is operated by the alternating electric power equal to or higher than 10 kHz.

* * * * *